United States Patent [19]

Shirazawa et al.

[11] Patent Number: 4,665,305

[45] Date of Patent: May 12, 1987

[54] CORROSION RESISTANT METAL PIPE WITH ELECTRODE FOR OIL WELLS

[75] Inventors: Takashi Shirazawa; Takeo Inoue, both of Hyogo, Japan

[73] Assignee: Mitsubishi Denki Kabushiki Kaisha, Tokyo, Japan

[21] Appl. No.: 713,664

[22] Filed: Mar. 19, 1985

[30] Foreign Application Priority Data

Mar. 19, 1984 [JP] Japan ..... 59-51124

[51] Int. Cl.[4] ..... H05B 3/03; E21B 43/24

[52] U.S. Cl. ..... 219/277; 166/60

[58] Field of Search ..... 501/15, 32, DIG. 3; 219/227, 278; 166/60, 65.1

[56] References Cited

U.S. PATENT DOCUMENTS

| | | | |
|---|---|---|---|
| Re. 15,727 | 12/1923 | Crossley | 501/32 |
| 1,878,178 | 9/1932 | Power | 106/DIG. 3 |
| 4,412,010 | 10/1983 | Ishii et al. | 106/DIG. 3 |
| 4,412,124 | 10/1983 | Kobayashi | 219/277 |
| 4,433,724 | 2/1984 | Nagano et al. | 166/60 |
| 4,436,955 | 3/1984 | Kyle | 501/15 |
| 4,567,945 | 2/1986 | Segalman | 166/65.1 |

*Primary Examiner*—M. Jordan

*Attorney, Agent, or Firm*—Sughrue, Mion, Zinn, Macpeak & Seas

[57] ABSTRACT

A corrosion-resistant metal pipe, and a process for producing the same, such as may be used in an electrode unit for electrically heating underground hydrocarbon resources or for conveying corrosive materials. The pipe may be produced in any desired length. In one embodiment, the corrosion-resistant pipe includes a base pipe element composed of at least two corrosion-resistant pipes joined by welding. The two pipes are stripped at adjacent ends of a first coat made of a glass-mica molded body formed on both inner and outer surfaces of the pipe. A plurality of communication holes are formed in the joint provided by welding the pipes. A second coat formed of a glass-mica molded body is then provided on both inner and outer surfaces of the joint with the second coat continuous with the first coat.

4 Claims, 48 Drawing Figures

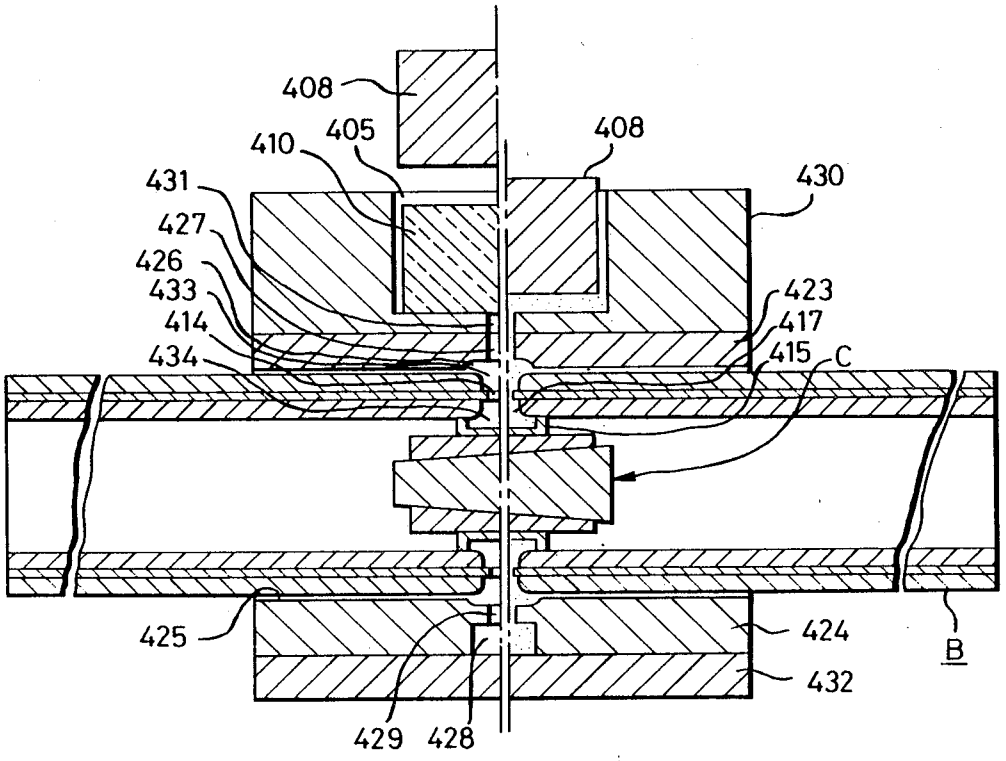
FIG. 24B
FIG. 24A
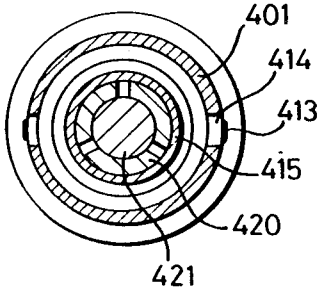
FIG. 23

CORROSION RESISTANT METAL PIPE WITH ELECTRODE FOR OIL WELLS

BACKGROUND OF THE INVENTION

The present invention relates to an electrode unit for electrically heating underground hydrocarbon resources and a process for producing the same. More particularly, the invention relates to an electrode unit for electrically heating an underground hydrocarbon containing stratum so that hydrocarbons of high viscosity and low flowability in that stratum are rendered sufficiently mobile to be easily recovered through a well. The invention also relates to a process for producing such an electrode unit.

Typical examples of underground hydrocarbons having high viscosity and low flowability are the bitumen present in oil sands or tar sands, and the kerogen present in oil shale.

Intensive studies have been made on the economic use of oil sands. Two methods are the subjects of current studies on the heating of underground oil formations: one involves injecting hot water or high-pressure steam into an underground oil formation through a steel casing, and the other method uses the Joule heat generated by applying an electric current between two electrodes spaced in the oil formation. The first method can be implemented with simple equipment, but it achieves only low efficiency. On the other hand, the second method has a theoretically very high efficiency (which has been verified by experiment), but it requires a highly sophisticated apparatus. The present invention relates in one aspect to an electrode unit for use in the second method.

Electric heating alone is unable to recover oil sands from the ground. In actual operation, electric current is applied to a pair of tubular electrodes attached to the bottom of casings, and after the viscosity of the oil is reduced, high-pressure steam is injected into one casing so as to pump the oil up through the other casing.

For a better understanding of the present invention, the characteristics required of an electrode unit used in the recovery of oil sands are described below, together with the state in which oil sands occur naturally and the method of their recovery.

Proved oil-sand deposits have been found in Canada, the United States and Venezuela. The oil in the oil-sand formations is present on the surface of the sand and between sand particles, often together with salt water. This oil is extremely viscous and does not flow in the naturally occurring state. Oil sand deposits are sometimes exposed in valleys or on river banks, but in almost all cases, they lie in a stratum several tens of meters thick and 200 to 500 meters below the surface of the ground. Oil sands could be excavated and the oil separated on the ground surface, but this is not a recommended practice, not only from an economical viewpoint, but also from ecological aspects. The oil alone must be extracted from the ground. The recovery of oil from a shallow deposit involves the danger of cave-in of the earth's crust, and thus it is generally recommended that the oil be extracted from strata lying at least 300 meters below the surface of the ground.

The biggest problem with the method of heating an oil-sand deposit by applying an electric current between electrodes is that the oil-sand deposit has a higher electrical resistance than the overlying geological formation. Although generalization is difficult because of variations among location and geological conditions, the oil-sand deposits have an average electrical resistivity of 100 ohm-m whereas the overlying formation has a resistivity of 10 ohm-m. If a current is impressed between two electrode units each consisting of an electrode buried in the oil-sand deposit and connected to a steel casing, the greater part of the current flows through the geological formation lying above the oil-sand deposit. In order to avoid this phenomenon, the surface of the casing in the layer above the oil-sand deposit must be covered with an insulator coat, or alternatively, each electrode must be insulated from the casing.

One aspect of the present invention concerns an improvement of the second approach. Such an electrode unit is shown schematically in FIG. 1, wherein steel casings 1, 11 have electrodes 3, 13 connected thereto through insulating members 2, 12. The electrodes 3, 13 are further connected to a power supply 5 on the ground through cables 4, 14. When a voltage is applied from the power source 5 to the electrodes 3, 13 in an oil sand stratum 6 through the cables 4, 14, a current 7 flows through the oil-sand stratum 6 and Joule heat is generated in an amount that increases with the electrical resistance of the oil-sand stratum 6. This Joule heat provides energy for heating the oil-sand stratum 6. Part of the current 7 flows not only through a formation 9 above the oil-sand stratum, but also through an underlying formation 10. This leakage current can be reduced by the insulator members 2, 12 disposed between the casings 1, 11 and electrodes 3, 13. When the temperature of the oil-sand stratum 6 has reached a predetermined value, the current is discontinued and hot water or high-pressure steam is injected into one of the two casings of the electrodes, for example, casing 1, from its top. The injected hot water or steam passes through the oil-sand stratum 6 and pushes the oil up through the other casing 11. In order to ensure smooth outflow of the hot water or high-pressure steam, a number of pores are usually provided in the electrodes 3, 13.

The electrode unit is usually fed with a sodium chloride solution through a separate pipe (not shown) in order to reduce the contact resistance between the electrodes 3, 13 and the oil-sand stratum 6. Partitions (not shown) are provided above the electrodes 3, 13 for the purpose of isolating the sodium chloride solution from the casings 1, 11, and the space above the partitions is filled with an insulating fluid.

The electrode unit described above must satisfy various requirements. First, it should not break during installation work. After the installation, the unit should be strong enough to withstand the pressure of the surrounding soil. Even when the temperature of the unit is increased as a result of the impression of an electric current (a particularly great temperature increase occurs in the neighborhood of each electrode because of high current density), the unit should be able to withstand the static pressure of the fluid in it without deformation or rupture. Finally, the unit should not burst or cause a leak during injection of hot water or high-pressure steam. As a guide, a electrode unit buried 500 meters below the surface of the ground is subjected to a pressure of 50 $kg/cm^2$ if the fluid with which the unit is filled has specific gravity of unity and, additionally, steam having a pressure of 50 $kg/cm^2$ and a temperature as hot as 265° C. can be passed therethrough.

The top of the insulating member 2 (12) is connected to the casing 1 (11) and the bottom is connected to the electrode 3 (13) so that the subjection of the insulator members 2, 12 to the pulling action of the electrodes is maintained. Since the electrodes are heated to 250° to 300° C., the insulator members 2, 12 are required to withstand not only the pulling action of the electrodes but also the high temperatures to which they are heated. When the insulator members are buried under the ground, usually a few hundred meters deep, they are installed as an assembly with the electrodes (3, 13) and casings (2, 12), and therefore it is practically impossible to prevent the insulators from contacting or colliding with the walls of the holes down which they are being pushed therethrough. Since the complete electrode unit is quite heavy, the slightest contact with the walls of the holes will cause a great mechanical impact on the insulators. Therefore, the insulator members 2, 12 are also required to have sufficient strength to safely withstand this mechanical impact.

Further, the present invention relates to an insulated metal cylinder and a process for producing the same. More particularly, the invention relates to a long insulated metal cylinder that has an insulator coat formed on the outer surface of a metal pipe or rod and which can be used in an temperature range of room temperature up to 300° C. without spalling or breakage of the insulation while exhibiting high mechanical strength and high resistance to temperature cycling and mechanical impact, as well as good electrical characteristics. The invention also relates to a process for producing such elongated metal cylinder.

Insulated metal cylinders having an insulator formed on the outer surface of a metal pipe or rod are used as fasteners for contacts in circuit breakers. Those which are used at relatively low temperatures (about 100° C.) commonly use organic insulators, and in some cases the insulator is made of a rolled sheeting of an organic material that is bonded to mica flakes with an organic adhesive.

Modern chemical plants, especially petrochemical complexes, use many gas or fluid conveying pipes having service temperatures as high as 200° to 300° C. The recent tendency is to replace these pipes by elongated insulated pipes having an insulator coat on the outer surface. Insulators made of organic materials will spall or peel entirely if they are subjected to elevated temperatures. This is an unavoidable physical phenomenon resulting from thermal expansion mismatching between the insulator and the metal pipe, and hence the organic insulator is entirely unsuitable for use under such elevated temperatures. A tubular insulator made of inorganic porcelain cannot be firmly fixed to the metal pipe so as to provide the necessary mechanical impact strength. A composite material based on asbestos containing an inorganic binder such as aluminum phosphate has a certain degree of mechanical strength and maintains fairly high electrical insulating properties at high temperatures. However, because of its inherent porous nature, this composite material has an unavoidable fatal defect in that its insulating properties drop suddenly if it is exposed to humid conditions at room temperature. Therefore, none of the insulating material available today exhibit completely satisfactory characteristics.

The present inventors previously proposed an insulator made of a glass-mica molded body. This insulator does not spall or drop if it is subjected to a temperature of about 300° C. In addition, it retains high mechanical strength in the range of room temperature up to 300° C., and exhibits high resistance to cold or heat and mechanical strength in the range of room temperature up to 300° C., and exhibits high resistance to cold or heat and mechanical impact while maintaining good electrical characteristics. Furthermore, the characteristics of this insulator are not deteriorated even if it is subjected to temperature cycling. In spite of these excellent properties, the insulator has one serious problem concerning its manufacture: a long unit of the insulator is not obtainable.

In order to facilitate a better understanding of the features of the present invention, the characteristics of a glass-mica molded body and the conventional process for producing an elongated metal cylinder will be described.

The characteristics of the glass-mica molded body are governed to a great extent by the characteristics of the glass used. A glass-mica molded body using a glassy material having a transition point of about 400° C. will not deform by softening even if it is subjected to a temperature of about 300° C., and retains mechanical strengths comparable to that exhibited at room temperature. The electrical characteristics of the glass-mica molded body depend greatly on its composition; unless it contains an extremely great amount of an alkali metal oxide, the characteristics of the glass-mica molded body will not deteriorate appreciably even at 300° C. and the necessary insulating properties can easily be ensured. Particularly good characteristics are exhibited by a glass mica molded body having lead oxide or zinc oxide as the principal base component, and boric acid or silicic acid as the principal acid component.

As regards the mica powder that is usable in preparing the intended glass-mica molded body, natural mica is not recommendable since, when heated in mixture with a glass powder, it reacts with the glass and is decomposed by losing the water of crystallization at a temperature lower than when it is heated independently. Synthetic mica having no water of crystallization is free from this tendency, and hence its powder is ideal for use in making the intended glass-mica is particularly advantageous.

A conventional insulated metal cylinder having an insulator coat made of the glass-mica molded body described above is shown in FIGS. 3A and 3B. FIG. 3A depicts an insulated rod having an insulator coat 201 of a glass-mica molded body formed around a metal rod 202, and FIG. 3B shows an insulated pipe having the same insulator coat 201 formed around a metal pipe 203. Both the metal rod 202 and the metal pipe 203 should preferably retain adequate mechanical strength and a thermal expansion coefficient of 8 to $11\times10^{-6}$ under heating to a temperature between 500° and 600° C., and they are advantageously made of a steel material.

An example of the conventional method for producing an insulated pipe having a metal pipe 203 in the center will be described with reference to FIGS. 4A and 4B. This method uses a shaping mold consisting of four elements, a frame 204, a housing 205 of a split type having a feed filling cavity 205-1 on the top, a support 206 having a projection 206-1 in the center for fixing the metal pipe 203, and a plunger 207.

The feed is prepared from a mixture of 35 vol % of a glass powder (size: 200 mesh, transition point: 420° C.) having a composition of 1.0 mole of $B_2O_3$, 1.2 moles of $SiO_2$, and 65 vol % of a synthetic fluorine-containing gold mica powder (size: 60 to 100 mesh). The mixed powder is wetted by addition of about 5 wt % of water, and the blend is cold-shaped with a press (not shown) into a cylindrical form that can be charged into the cavity 205-1. The cylinder is dehydrated to form a compact 208. As shown in FIGS. 4A and 4B, the top of the center through-hole in the insulated pipe 203 is sealed.

The shaping with this mold proceeds as follows. The frame 204, housing 205 and support 206 are assembled as shown in FIG. 4A, and the plunger 207 is left free. The mold is heated to 500° C., the metal pipe 203 to 600° C., and the compact 208 to 800° C. After completion of the heating, the metal pipe 203 is placed on the support 206 within the housing 205, and the compact 208 is then charged into the cavity 205-1, as shown in FIG. 4A. Subsequently, the plunger 207 is placed on the compact 208 and urged with a press (not shown) against the compact 208 so that an insulator coat 201 is formed by forcing the compact 208 into a space 209 defined by the housing 205 and the metal pipe 203, as shown in FIG. 4B. The insulator coat 201 is cooled to 400° C. (lower than the glass transition point) and the mold is disassembled to recover the shaped article, which is mechanically worked to provide an insulated pipe which, as shown in FIG. 4B, has a cylindrical insulator coat 201.

A short insulated rod or pipe that is produced by the method described above exhibits highly preferred characteristics since the insulator coat at position 201-1 near the area of contact with the plunger has a density close to that of the insulator coat at position 201-2, which is the farthest from position 201-1. However, as already mentioned, the conventional method has a fatal problem in that it cannot be used to fabricate a long insulated metal cylinder having the desired characteristics. The reasons are as follows: The mixture of glass and mica powders from which the insulator coat is made remains highly viscous even if it is heated. The viscosity of this mixture is highly dependent on the temperature so that it decreases with increasing temperature. A lower viscosity prevails if the compact 208 is heated to a higher temperature during molding, but the higher the temperature, the faster the rate of erosion of the mica by the glass. As a natural consequence, the temperature of heating the glass-mica blend is limited to a maximum of 800° to 850° C. From a strength viewpoint, the shaping mold cannot be heated to a temperature higher than 500° C. During the shaping process, the compact 208 pressurized by the plunger 207 flows into the space 209, but when a temperature drop occurs as a result of contact with the inner wall of the housing, the viscosity of the molten compact increases rapidly and it no longer flows smoothly. As the length of the insulating area is increased, the space at position 201-2 is not completely filled with the molten compact 208 to provide a high density. This is why a long insulator coat 201 having uniform density cannot be formed.

This phenomenon is unavoidable and explains why a long insulated pipe having the desired characteristics cannot be produced by the prior art technique.

Petrochemical complexes and other chemical plants handle gases or liquids that show little corrosive effects on metals at room temperature but which become severely corrosive at elevated temperatures. At room temperatures, such gases or liquids can be conveyed through metal pipes. The transport efficiency of such liquids or gases is appreciably increased, however, if their temperature is increased to 200° to 300° C. at several points of the transport path. In this case though, if hot and, therefore corrosive, gases or liquids are conveyed, metal pipes having outer insulation coats must be employed at many points of the transportation circuit for safety reasons. In order to meet this requirement and secure an adequate mechanical strength, insulated and corrosion-resistant pipes composed of a metal pipe having a corrosion-resistant layer on the inner surface and an insulating layer on the outer surface can be used. (This type of metal pipes is hereunder referred to simply as corrosion-resistant pipes.) Many studies have been made regarding the fabricating of such corrosion-resistant pipes.

Among the pipes that have been previously proposed are metal pipes having a coat of a heat-resistant organic material formed on both inner and outer surfaces. Teflon and PEEK resins are organic materials having very high resistance to heat and corrosion. However, because of the inherent thermal expansion mismatching with the metal pipe, the organic coat expands at elevated temperatures and may spall in an extreme case. As a guide, organic materials have thermal expansion coefficients five to 10 times as great as that of a steel pipe. Because of this fatal defect, heat-resistant organic materials are not suitable for use in the manufacture of corrosion-resistant pipes having high service temperatures.

The use of inorganic materials has also been considered, and steel pipes with an enamel coat show great promise. The glaze used in enamelling steel pipes must have a thermal expansion coefficient between 10.5 and $12.0\times10^{-6}$. This means a suitable glaze must have high concentrations of oxides of alkali metals such as lithium, potassium and sodium. The resulting enamel, often used for coating tableware, exhibits satisfactory resistance to the corrosive action of water having a temperature up to 100° C. However, if the temperature of the water exceeds 100° C. and if it is acidic, the corrosion resistance of the enamel coat suddenly drops to a practically unusable level.

Therefore, none of the materials so far proposed for use in the production of corrosion-resistant pipes has proved practically usable.

On the other hand, corrosion-resistant pipes having a coat of glass-mica molded body formed on both inner and outer surfaces have neither deformation nor spalling problems even at elevated temperatures between 200° and 300° C. In addition, a glass-mica molded body containing 50 to 70 vol % of a mica powder has a very high corrosion resistance, and therefore it exhibits excellent resistance to hot water, acids and alkalies, as well as good electrically insulating characteristics. Additionally, a thick and gas-permeable coat can be made from the glass-mica molded body. Therefore, the glass-mica molded body is considered to be ideal for use as a coating material for the corrosion-resistant pipe described above.

A problem, however, is that a long, corrosion-resistant pipe having a coat of glass-mica molded body cannot be produced by the conventional fabrication method.

The characteristics of the glass-mica molded body and the conventional process for fabricating a corrosion-resistant pipe with this body will hereunder be described. As mentioned above, the characteristics of the glass-mica molded body are governed to a great extent by the characteristics of the glass used in the molded body. A glass-mica molded body using a glassy material having a transition point of about 400° C. will not deform even if it is subjected to a temperature of about 300° C. Additionally, the electrical properties and mechanical strength of such glass-mica molded body are little different from those exhibited at room temperature. The thermal expansion coefficient of the glass-mica molded body is also highly dependent on the characteristics of the glass, and by changing the latter, glass-mica molded bodies having thermal expansion coefficients in the range of 8 to $11\times10^{-6}$ can be obtained. The close relationship between the glass and the glass-mica molded body also applies to the corrosion-resisting properties, and a glass-mica molded body having improved corrosion resistance can be prepared using a highly corrosion-resistant glass.

Regarding the mica that is usable in preparing the intended glass-mica molded body, natural mica is not recommendable since it has a low pyrolytic temperature due to the presence of water of crystallization and because it is available in such various grades that products having consistent characteristics are hard to obtain. On the other hand, synthetic mica has a high thermal decomposition temperature and it is easy to obtain products having a consistent quality. Therefore, synthetic mica is exclusively used in the glass-mica molded body of interest. A synthetic fluorine-containing gold mica is particularly advantageous.

A corrosion-resistant pipe having a coat of the glass-mica molded body that is formed on both inner and outer surfaces by the conventional method will now described by reference to FIG. 5, wherein the corrosion-resistant pipe generally indicated at A is composed of a metal pipe 301 covered with an inner coat 302 and an outer coat 303.

The conventional method for producing such corrosion-resistant pipe is next described by reference to FIGS. 6A and 6B. This pipe is fabricated with a shaping mold. The mold consists of four components, a frame 304, a splittable housing 306 with a feed filling cavity 305 in the top, a support 307 having a projection 307-1 for retaining an insert 309 and the metal pipe 301 in the central position, and a plunger 308.

The glass in the feed has, for instance, a composition of 70 wt % PbO, 16 wt % $B_2O_3$ and 14 wt % $SiO_2$, a transition point of 400° C., and is used after being ground to a size of 200 mesh. The mica in the feed is a powder of synthetic fluorine-containing mica having a grain size of 60 to 100 mesh. Equal weights of the glass and mica powders are mixed to prepare the feed powder, which is set by addition of about 5 wt% of water. The blend is cold shaped with a press (not shown) into a cylindrical form that can be charged into the cavity 305. The cylinder is dewatered to form a compact 310.

The shaping with this mold proceeds as follows: The frame 304, housing 306 and support 307 are assembled as shown in FIG. 6A, and the plunger 308 is left free. The mold is heated to 550° C., the insert 309 and metal pipe 301 to 600° C., and the compact 310 to 800° C. After completion of the heating, the insert 309 and metal pipe 301 are placed on the support 307 within the housing 306, and the compact 310 is then charged into the cavity 305, as shown in FIG. 6A. Subsequently, the plunger 308 is placed on the compact 310 and urged with a press (not shown) against the compact 310 so that the latter is forced into a space 311 that is defined by the metal pipe 301 and insert 309, as well as into a space 312 defined by the metal pipe 301 and the housing 306, thereby forming an inner coat 302 and an outer coat 303, as shown in FIG. 6B. These coats 302 and 302 are cooled at 380° C. (lower than the glass transition point) and the mold is disassembled to recover the shaped article, which is mechanically worked to cut off the insert 309 and provide the corrosion-resistant pipe A as shown in FIG. 5.

The corrosion-resistant pipe A fabricated by the conventional method described above possess ideal characteristics if its length is small, but a fatal problem is that a long pipe having the desired characteristics cannot be obtained. The reasons are as follows: The mixture of glass and mica powders from which the corrosion-resistant coat is made remains highly viscous even if it is heated. The viscosity of this mixture is highly dependent on temperature so that it decreases with increasing temperature and increases rapidly with the decreasing temperature. A lower viscosity prevails if the compact 310 is heated to a higher temperature during molding, but the higher the temperature, the faster the rate of erosion of the mica by the glass. As a natural consequence, the temperature of heating the glass-mica blend is limited to a maximum of 800° to 850° C. The temperature of the shaping mold is also related to the mechanical strength, and it cannot be heated to a temperature higher than 550° C. During the shaping process, the compact 310 pressurized by the plunger 308 flows into the spaces 311 and 312, but the temperature of the compact 310 drops since its front is flowing in contact with the insert 309, metal pipe 301 and the inner wall of the housing 306. As a result of this temperature drop, the viscosity of the compact 310 increases rapidly and it no longer flows smoothly. As the length of corrosion-resistant pipe is increased, the bottom portions 311-1 and 312-1 of the spaces 311 and 312, respectively, are not completely filled with the molten compact 310 to provide a high density. For this reason, a long corrosion-resistant pipe having a uniform inner coat 302 or outer coat 303 cannot be produced.

This phenomenon is unavoidable in the conventional process and explains why a long corrosion-resistant pipe. The prior art process also requires the step of cutting off the insert 309 from the shaped article by mechanical working, but this step is quite time-consuming and leads to a high price of the final product.

Moreover, the casing (1, 11) used under the conditions discussed above must meet strict requirements. The first requirement to be satisfied is high mechanical strength. Since the casing must be strong enough to withstand the internal pressure and the pulling action of a suspended object, the inevitable choice is a metal pipe. Secondly, the casing must have good corrosion resistance. However, the life of a metal pipe is quite short under the expected severely corrosive environment where the casing is subjected to heated steam (300° to 320° C.) in the presence of sodium chloride or hydrogen sulfide. Thirdly, the casing must be airtight in order to avoid any leakage of the oil into a geological formation above the oil-sand stratum. The part of the casing buried in the oil-sand formation must have a particularly great corrosion resistance, but the requirements for the part of the casing in the overlying geological formation are far less stringent.

The choice of the material for the part of the casing to be buried in oil-sand deposits is quite limited, and the practically feasible casing is a corrosion-resistant pipe having a coat of a corrosion-resistant material formed on both inner and outer surfaces of a base metal pipe.

Corrosion-resistant coats formed on the metal pipes are commonly made of PEEK resins or Teflon resins. These resins, when used alone, exhibit very good heat- and corrosion-resistant characteristics, and corrosion-resistant pipes having coats of such resins on both inner and outer surfaces of a metal pipe can be used very effectively if their service temperature is in the range of from room temperature up to 100° C. However, this is not the case for the temperature range of 300° to 320° C. to which the actual casing is subjected. PEEK resins or Teflon resins, as mentioned previously, have thermal expansion coefficients five to 10 times as great as that of the metal pipe, and as the temperature rises, the coat made of such resins deform greatly and may either spall or break in an extreme case. This phenomenon is highly likely to occur when the coat is subjected to temperature cycling, and hence the resins mentioned above are entirely unsuitable for use in making the intended corrosion-resistant pipe.

On the other hand, the glass-mica molded body has a thermal expansion coefficient that matches well with that of the metal pipe, and so, a corrosion-resistant pipe having a coat of this molded body formed on the metal pipe will not suffer from spalling, breaking or peeling of the coat even if the pipe is used at 300° to 320° C. or subjected to temperature cycling within this range. In addition, the coat of glass-mica molded body exhibits excellent resistance to hot water, salt water or $H_2S$-containing water that has a temperature of about 300° C. Therefore, a metal pipe having the coat of glass-mica molded body is considered to be ideal for use as a corrosion-resistant pipe, but, as explained above, since a long unit of the pipe cannot be fabricated, this pipe is not suitable for use as a casing through which high-pressure steam is forced to recover the oil-sand deposits.

In geothermal power generation, hot water having higher temperatures than that obtainable from the existing hot springs is used. This hot water is usually pumped and conveyed through steel pipes, but the metal pipes tend to rapidly corrode, and further their life is shortened if the hot water is acidic. From an economical viewpoint, there is a rapidly growing need for the use of pipes having improved corrosion resistance. The prerequisite for these pipes is that they have high mechanical strength and that the inner surface of the pipe have a particularly great corrosion resistance. Pipes made of organic materials and having good corrosion resistance are available in many types of commercial products, but because of their low mechanical strength, such organic pipes cannot be used independently for conveying hot fluids. Metal pipes having an inner coat of an organic material exhibit very good characteristics under room temperature conditions, but not at elevated temperatures. A glass-mica molded body inner layer is thus preferred. Such a glass-mica molded body also exhibits good electrical insulating properties and hence may be effectively used in electrical insulator tubes.

A pipe having an inner coat of a glass-mica molded body formed on the inner surface by a conventional method is now described by reference to FIG. 7A, wherein the pipe generally indicated at 500 consists of a metal pipe 501 having a coat 502 on the inner surface.

The conventional method for producing such pipe will next be described with reference to FIGS. 7B and 7C. This pipe is fabricated with a shaping mold. The mold is composed of four components, a frame 504, a splittable housing 506 with a feed filling cavity 505 in the top, a support 507 having a projection 507-1 for retaining an insert 509 in the central position, and a plunger 508.

The plunger 508 is placed on a compact 510 and urged with a press (not shown) against the compact 510 so that the latter is forced into a space 511 defined by the metal pipe 501 and the insert 509, thereby forming the coat 502 as shown in FIG. 7C. The coat 502 is cooled to 380° C. (lower than the glass transition point) and the shaping mold is then disassembled to recover the shaped article, which is mechanically worked to cut off the insert 509 and provide the coated pipe 501 as shown in FIG. 7A.

During the shaping process, the compact 510, pressurized by the plunger 508, flows into the space 511, but when the temperature of the compact 510 is reduced as a result of contact with the insert 509 and metal pipe 501, the viscosity of the compact increases rapidly and it no longer flows smoothly. As the length of the coated pipe is increased, the front portion 502-1 in FIG. 7B and 7C is not completely filled with the compact 510 to provide a high density. This is why a long pipe having a uniform coat 502 cannot be produced.

SUMMARY OF THE INVENTION

The present inventors commenced their development of an electrode unit useful for electrically heating oil-sand deposits by making studies on an insulated pipe joint that would provide by making studies on an insulated pipe joint that would provide an effective insulating member. The characteristics the inventors wanted the joint to process were as follows: (1) high mechanical strength capable of holding suspended electrodes; (2) high breakdown voltage that withstands the application of a voltage of 4,000 to 5,000 volts between the electrodes; (3) the ability to retain properties (1) and (2) even when the ambient temperature is increased to about 300° C. as a result of current flow between the electrodes; (4) high resistance to temperature cycling; (5) high mechanical impact strength capable of withstanding the unavoidable contact with the walls of holes down which the insulator members are pushed therethrough; (6) high conductance that is realized by a center through-hole having an inside diameter equal to that of the casings (1,11) above and the electrodes (3,13) below; (7) ability to retain a high degree of water (or oil) tightness under the extreme temperature conditions which are to be expected; (8) long-term reliability so as to eliminate any time-dependent changes in the performance; and (9) ease of connection between the insulator members and the casings 1, 11 and electrodes 3, 13.

The present invention has been accomplished in order to solve this problem. One object of the invention is met by providing an elongated insulated metal cylinder that is composed of a plurality of metal cylinders having a first insulator coat made of a glass-mica molded body and which are welded together at their ends, each of which is partly stripped of the insulator coat to expose the base metal, with a second insulator coat also made of a glass-mica molded body being deposited at the welded ends. Another object of the present invention is met by providing a process for producing such an elongated metal cylinder.

The present invention has further been accomplished in order to provide a long insulated pipe or rod that is not only free from the development of cracks in the insulator coat, but which also retains perfect insulation characteristics. The inventors have successfully established a process for attaining this objective and the desired long insulated pipe can be produced by the present invention.

The process in accordance with the present invention uses a shaping mold unit and a shaping jig. The mold unit consists of a splittable lower mold having a through-hole in the transversal direction and an upper mold having a feed-filling cavity. The shaping jig has an insert with a tapered outer surface and is capable of holding a metal pipe in position. According to the present invention, the shaping jig is inserted into the through-hole, and as a compact in the filling cavity, the mold unit and the shaping jig are heated, the compact is caused to flow under pressure and form a coat of glass-mica molded body on both the inner and outer surfaces of the metal pipe provided with a plurality of inflow and outflow channels. This process of the present invention enables the production of an inexpensive long corrosion-resistant pipe without any subsequent mechanical working.

In accordance with another embodiment, the present invention provides a process for producing a long corrosion-resistant pipe by first providing at least two short corrosion-resistant pipes each having a first coat of a glass-mica molded body on both inner and outer surfaces of a metal pipe, then removing part of the first coat from one end of each pipe to expose the base metal pipe, welding together the exposed ends, forming plurality of communicating holes at the weld, and providing a second coat of the glass-mica molded body which is continuous to the first coat. The present invention also relates to a long corrosion-resistant pipe produced by this process.

The invention still further provides a process for producing a corrosion-resistant metal pipe with a shaping mold unit comprising a lower mold with a transversal through-hole into which a shaping jig is inserted, and an upper mold that is directly coupled to the top of the lower mold and which has a feed-filling cavity into which a compact that becomes mobile upon heating under pressure is charged. The process of the present invention comprises steps of mounting on the shaping jig a metal pipe having a plurality of channels for the passage of the compact, inserting the shaping jig into the through-hole, assembling the compact, shaping mold unit and shaping jig while they are hot, and pressurizing the compact so that it flows and forms a coat of a glass-mica molded body on the inner surface of the metal pipe.

BRIEF DESCRIPTION OF THE DRAWINGS

FIGS. 2A and 2B are cross-sectional views of a conventional insulated pipe joint, of which FIG. 2A shows a longitudinal section of the final product and FIG. 2B a partial longitudinal sectional view of the joint during its molding process;

FIG. 3A. and 3B show a conventional insulated pipe joint, of which FIG. 2A shows the pipe in cross section prior to use and FIG. 2B a similar view of the pipe but after the pipe has been in service for a time;

FIG. 4A shows schematically a conventional process for producing an insulated metal tube, of which FIG. 4A shows a partial longitudinal section of a state immediately before the start of shaping under pressure and FIG. 4A the state after completion of shaping;

FIG. 6A and 6B are longitudinal sectional views illustrating a conventional method for producing the pipe of FIG. 5, of which FIG. 6*a* shows a state just prior to the start of molding under pressure and FIG. 6B shows the state after completion of molding under pressure;

FIG. 7B and 7C illustrate schematically a conventional process for producing the corrosion-resistant pipe of FIG. 7A, of which FIG. 7B is a longitudinal sectional view showing the state immediately before the start of shaping under pressure and FIG. 7 the state after completion of shaping;

FIG. 8A and 8B illustrate an insulated pipe of the invention, of which FIG. 8A is a partial longitudinal sectional view showing the construction of the pipe before use and FIG. 8B a partial longitudinal sectional view showing the structure of the pipe during service;

FIGS. 9A and 9B show a pipe joint connected to and insulated pipe according to the invention, of which FIG. 9A shows a partial longitudinal sectional view of the joint as connected to the insulated pipe and FIG. 9B a partial longitudinal sectional view showing the assembly of the pipe and joint after formation of a linking insulator;

FIGS. 10A and 10B illustrate a preferred embodiment of a method for shaping a linking insulator, of which FIG. 10A shows a partial longitudinal sectional view showing a state immediately before shaping under pressure and FIG. 10B a longitudinal sectional view showing the state after shaping under pressure has been completed;

FIGS. 14A and 14B illustrate a process of the present invention for producing the pipe of FIG. 12, of which FIG. 14A is a partial longitudinal sectional view and FIG. 14B is a corresponding partial cross-sectional view;

FIGS. 15A and 15B further illustrate a process of the invention for producing the pipe of FIG. 12, here, after completion of a shaping step, of which FIG. 15A is a partial longitudinal sectional view and FIG. 15B a corresponding partial cross-sectional view;

FIGS. 16A and 16B illustrate steps in a method of the invention, of which FIG. 16A is a longitudinal sectional view showing a state just before the start of molding under pressure and 16B shows a state at the completion of the molding step;

FIGS. 19A and 19B are longitudinal sectional views of a shaped article produced by the process illustrated in FIGS. 16A through 17B, of which FIG. 19A shows the article during processing and FIG. 19B the completed product;

FIG. 23 is a cross-sectional view taken along a line VI—VI in FIG. 22;

FIGS. 24A and 24B are longitudinal sectional views illustrating a process of the invention for producing a pipe as illustrated in FIG. 20, of which FIG. 24A shows a state immediately before the start of shaping under pressure and FIG. 24B a state after completion of shaping;

FIGS. 26A and 26B are longitudinal sectional views illustrating another process for producing a pipe of the invention, of which FIG. 26A shows a state immediately before the start of molding under pressure and FIG. 26B a state at the completion of molding;

DESCRIPTION OF THE PREFERRED EMBODIMENTS

The present inventors have succeeded in producing an insulated pipe joint satisfying the requirements listed above. The construction of this joint is hereunder described by reference to FIGS. 2A and 2B.

Figure 2A:
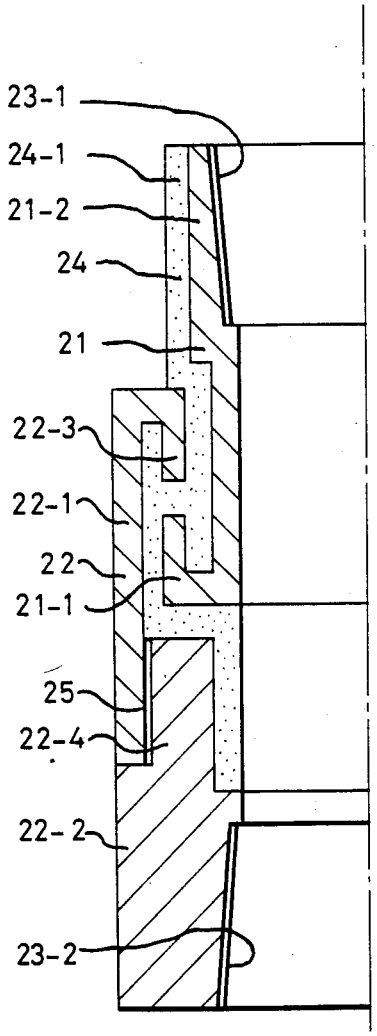
FIG. 2A PRIOR ART

As shown in FIG. 2A, the joint in its finally produced form is composed of an internal metal member 21 in a hollow cylindrical form, an external metal member 22 which is also in a hollow cylindrical form, and an insulator 24 interposed between the two metal members. Each of the metal members is made of steel. The internal metal member 21 has an outer ring 21-1 formed at the lower end. The external metal member 22 is composed of an upper part 22-1 and a lower part 22-2. The upper part 22-1 has at its upper end an inner ring 22-3 that faces the outer ring 21-1 on the internal metal member 21. The internal metal member 21 is inserted into the upper part 22-1 of the external metal member 22 so that the wall 21-1 is held apart from the inner ring 22-3 by a certain dimension. The lower end of the upper part 22-1 is connected at 25, by either a threaded connection or welding, to the outer periphery of the wall 22-4 of the lower part 22-2. The wall 22-4 has a larger inside diameter than the internal metal member 21. The insulator 24 fills the space between the internal metal member 21 and the external metal member 22. The insulator covers both the outer surface of the wall 21-2 of the internal metal member 21 and the inner surface of the wall 22-4 of the external metal member 22. The insulator 24 is made of a glass-mica molded body.

Figure 2B:
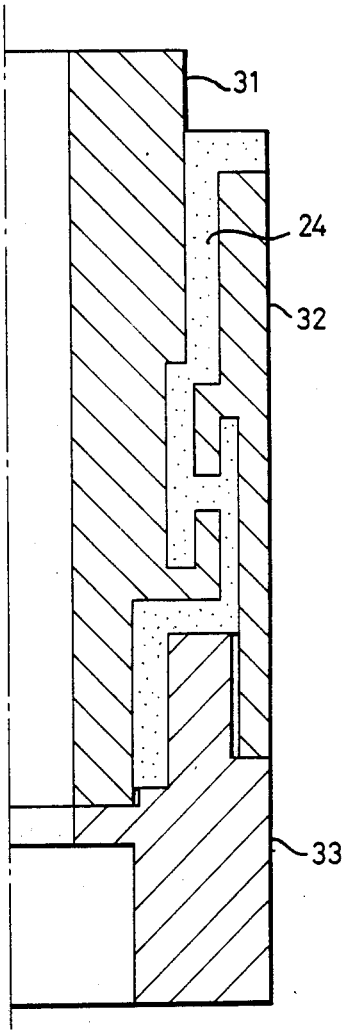
FIG. 2B PRIOR ART
Figure 4A:
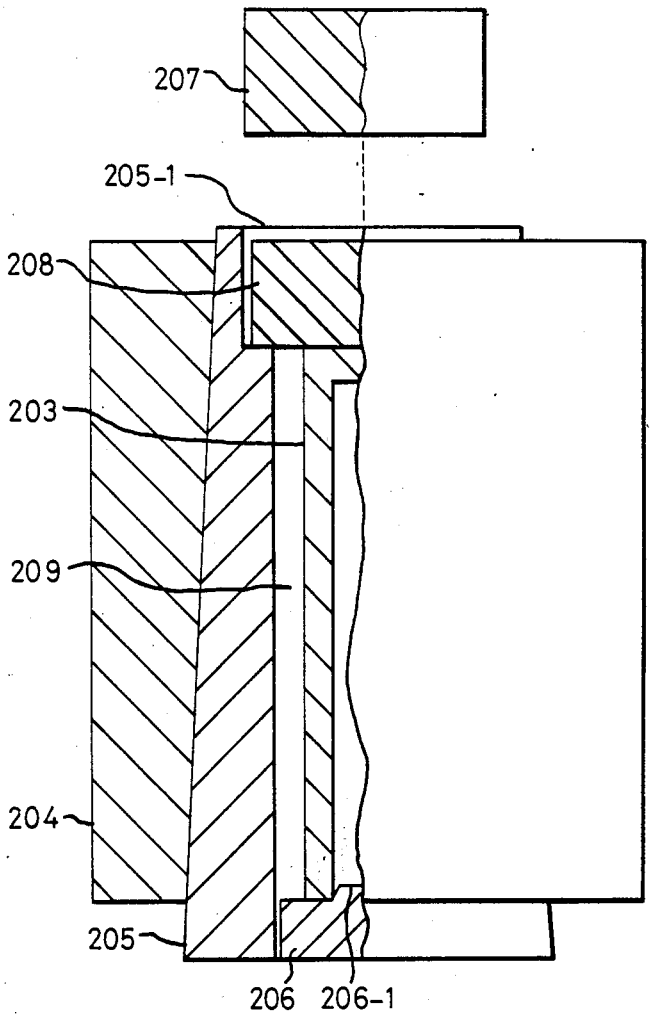
FIG. 4A PRIOR ART
Figure 4B:
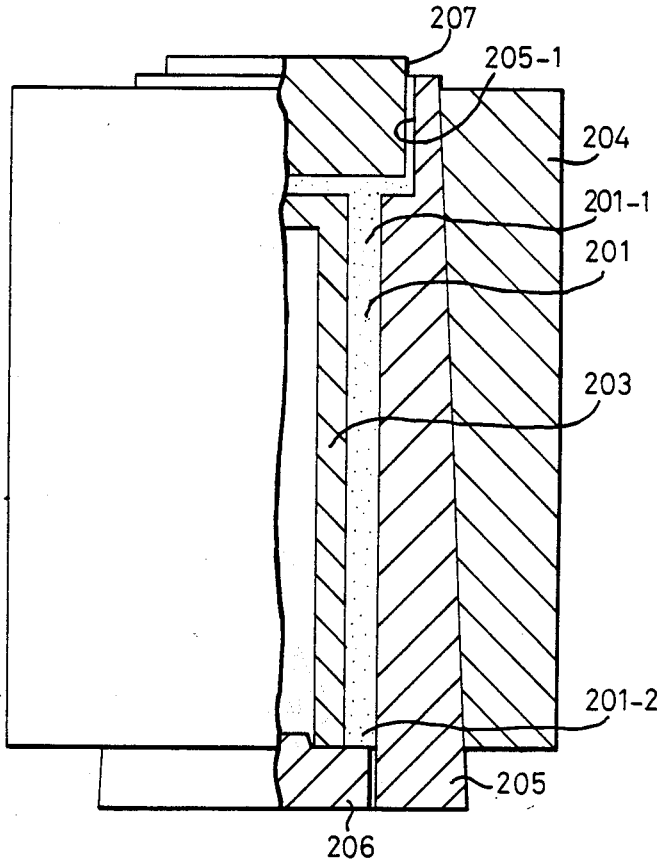
FIG. 4B PRIOR ART
Figure 5:
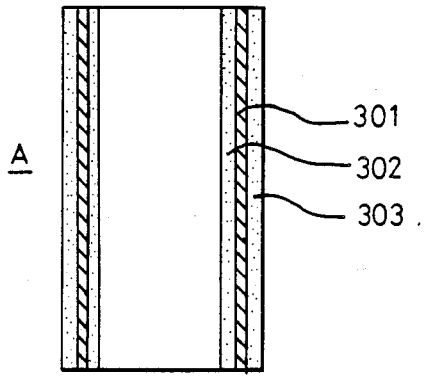
FIG. 5 PRIOR ART
FIG. 5 is a longitudinal sectional view of a conventional corrosion-resistant pipe.
Figure 7A:
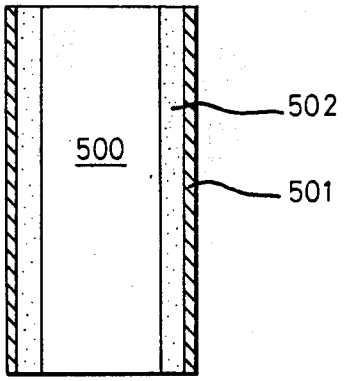
FIG. 7A PRIOR ART
FIG. 7A is a longitudinal sectional view of another conventional corrosion-resistant pipe.

The insulated pipe joint shown in FIG. 2A is prepared as follows: An inner metal member 31 and outer metal members 32, 33, having the shapes shown in FIG. 2B, are set in a mold unit (not shown) used to form the insulator 24 from a glass-mica molded body. The resulting assembly is mechanically worked to provide a pipe joint having the shape shown in FIG. 2A. The glass-mica molded body is such that its thermal expansion coefficient at a temperature below the glass transition point is smaller than that of the steel of which the internal and external metal members 21, 22 are made. During the molding step, both the metal members and the glass-mica molded body are heated to temperatures above the glass transition point so that, in the subsequent cooling process, the outer surface of the glass-mica molded body is forced inwardly by the strong clamping action of the outer metal members 32, 33. This clamping action is reduced in a subsequent heating cycle, but then the inner surface of the glass-mica molded body is forced outwardly by the strong clamping action of the outer surface of the inner metal 31.

As mentioned above, the internal metal member 21 has the outer ring 21-1 and the external metal member 22 has the inner ring 23-3. The insulator 24 is firmly held between the two metal members, and hence there will occur no looseling of the insulator due to temperature cycling. Therefore, the insulated pipe joint ensures not only good water (or oil) tightness, but also the desired mechanical strength at any temperature ranging from room temperature up to 300° C. The joint also provides a strong resistance to the pulling action of a suspended electrode since the outer ring 21-1 of the internal metal member 21 is positioned to face the inner ring 22-3 of the external metal member 22.

The pipe joint described above can be connected to the casings 1, 11 and the electrodes 3, 13 by either a threaded connection or welding. If the connection is provided by a threaded connection, the internal metal member 21 and external metal member 22 are provided with female threads 23-1 and 23-2, respectively.

Although the insulated pipe joint shown above has most of the characteristics required for use in an electrode unit, it has one unavoidable defect in terms of its surface insulation characteristics. As already mentioned, an aqueous solution of sodium chloride is piped into the electrode unit in order to reduce the contact resistance between the electrodes and the oil-sand deposit. Since the pipe joint is unavoidably surrounded by the highly conductive sodium chloride solution, it is necessary to ensure good surface insulation characteristics by forming a long insulation zone on the outer surface of the joint. This consideration is not necessary for the inner surface of the joint because, as will be shown hereinafter, partitions are provided above the electrodes 3, 13 in order to isolate the sodium chloride solution from the casings 1, 11, and also the space above these partitions is filled with an insulating fluid.

The outer surface insulation characteristics of the pipe joint are determined by the length of the insulator 24-1 formed around the wall 21-2 of the internal metal member 21. However, there is an inherent limitation on the maximum length of such an insulator, it cannot be made longer than about one-half its inside diameter. This limitation, largely due to the difficulty in shaping a longer insulator, could be removed by using large equipment, but this is not economically feasible.

The present invention solves this problem. The invention realizes a substantially ideal electrode unit by making use of a insulated pipe joint having excellent performance characteristics while ensuring the desired surface insulation of the joint. More specifically, the present invention provides an electrode unit for electrically heating underground hydrocarbon resources wherein an insulted pipe having an insulator coat formed on the outer surface of a metal pipe is joined at both ends to an insulated pipe joint having an inner metal member and wherein a linking insulator is formed between the insulator coat and each of the opposing insulator coats on the outer surfaces of the internal metal members on the two joints. The present invention has as another object the provision of a process for producing such an electrode unit.

The first requirement that must be satisfied is the preparation of an insulated pipe having an insulator coat firmly adhered to the outer surface. If the intended service temperature is within the range of from room temperature up to about 100° C., a product having high corrosion resistance and other desired properties can be readily produced by the formation of an organic insulator coat. However, the situation differs greatly if the service temperature approaches 300° C., as in the case of the electrode unit contemplated by the present invention. It is necessary to select a material that is capable of withstanding temperatures up to 300° C.

Polyethylene fluorides (Teflon), polyethers and polyetherketones (PEEK) may be considered. However, these polymers have thermal expansion coefficients which are greater than those of the substrate steel by about an order of magnitude. At elevated temperatures, flexible materials such as polyethylene fluorides deform considerably, whereas nonflexible materials such as polyethers and polyetherketones will eventually break. This problem may be avoided if the steel tube is of a small size and the absolute value of the difference between the amounts of heat expansion and shrinkage is very small. However, if the dimensions (e.g., diameter and length) of the pipe are increased, the absolute value of the difference between the amounts of heat expansion and shrinkage are also increased. This is an unavoidable physical phenomenon. Since the electrode unit of the type envisaged by the present invention has a diameter ranging from 200 to 250 mm and a length of about 1 to 2 m, it is not practical to make an insulated layer of one of the organic materials listed above.

In order to make an insulated pipe having an insulator coat on the outer surface that is free from the problems of spalling or breakage in the range of from room temperature at 300° C., the insulator coat must be made of a material whose thermal expansion coefficient is close in the stated temperature range to that of a steel pipe. In addition, the material selected should have not only the desired electrical and mechanical characteristics in that temperature range, but also high resistance to corrosion and to the thermal shock resulting from temperature cycles, as well as long-term reliability. Only a limited number of materials can satisfy all of these requirements.

Figures 8A, 8B:
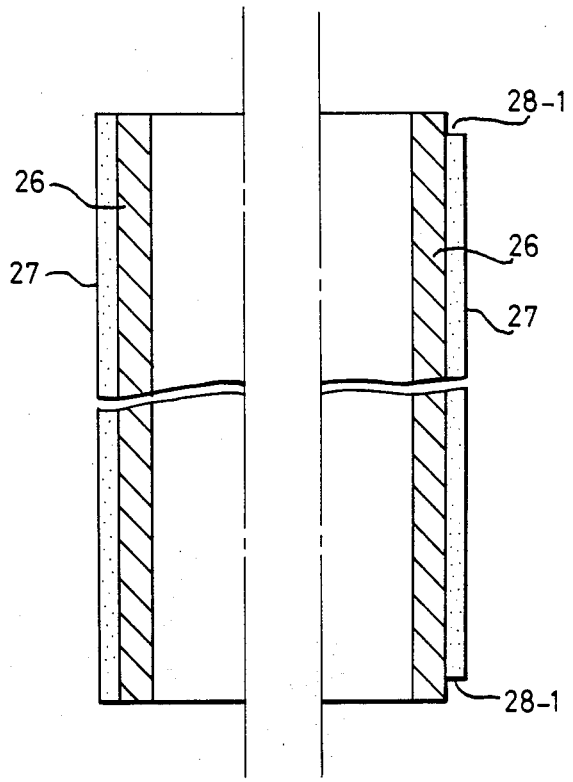

In accordance with the present invention, an insulated pipe is provided including a steel pipe on the outer surface of which is formed an insulator made of a glass-mica molded body that is used to form the insulated pipe joint described hereinbefore. This particular insulated pipe will hereunder be described by reference to FIGS. 8A and 8B. FIG. 8A shows the construction of this insulated pipe. As shown, this construction includes a metal pipe 26 covered with an insulator coat 27. The metal pipe 26 is made of a steel having a thermal expansion coefficient of $11.8\times10^{-6}$ and the insulator coat 27 is made of a glass-mica molded body having a thermal expansion coefficient of $11.5\times10^{-6}$ in the range of room temperature to 400° C. Because of the proximity between the thermal expansion coefficients of the steel pipe and the glass-mica molded body, the insulator coat 27 is entirely free from the problems of spalling or breakage, even if subjected to temperature cycles between room temperature and 300° C. The glass-mica molded body of which the insulator coat 27 is made has a greater thermal expansion coefficient than the insulator 24 on the pipe joint, and can be prepared by using a glass having a higher thermal expansion coefficient.

A very important aspect of the present invention lies in the manner of connecting the outer insulation 24-1 on the joint shown in FIG. 2A to the insulation coat 27 on the pipe 2 in FIGS. 8A and 8B without impairing the insulation properties of the coats 24-1 and 27.

Figure 9A:
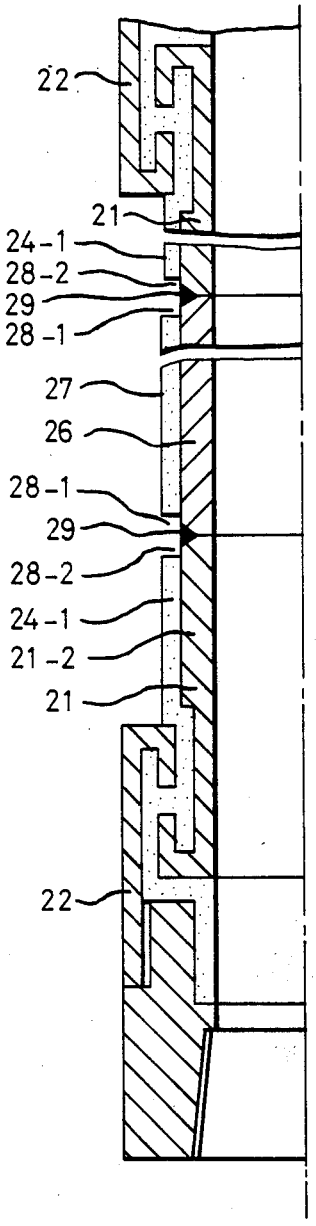
Figure 9B:
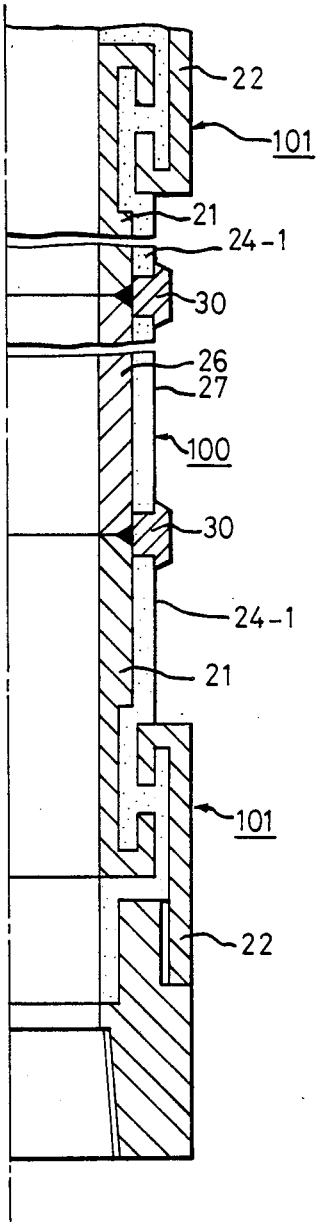

First, as shown in FIG. 8B and FIG. 9A, the insulation coat 27 on both ends of the insulated pipe is stripped at 28-1 to expose the metal pipe 26. Then, the wall 21-2 of the joint, which is partly stripped at 28-2 of the outer insulation 24-1, is connected end-to-end with each of the metal pipes 26. Most desirably, the wall 21-2 and metal pipe 26 have the same inside and outside diameters. The connected ends are fastened together by welding at 29. Most ideally, the welding is effected with an electron beam since such causes a minimum increase in the temperature around the weld. The resulting unitary assembly of the insulated pipe 100 having the joint 101 welded to each end is shown in FIG. 9B. At each of the welds 29, linking insulation 30 is formed so that it provides the desired insulating properties while ensuring intimate contact with the insulation 24-1 and insulation coat 27, as shown in FIG. 9B. As a result, the outer insulation 24-1, linking insulation 30, and insulation coat 27 form a continuous outer insulation layer, ensuring excellent insulating characteristics for the outer surface of the joint 101 connected to both ends of the insulated pipe 100.

The linking insulation 30 should satisfy the following requirements. No gap should be present between the mating surfaces of the insulation 24-1 and the adjacent insulator coat 27 in order to ensure complete insulating properties. In view of the intended service temperature (between room temperature and 300° C.), the linking insulator 30 should have a thermal expansion coefficient matching those of the wall 21-2 and metal pipe 26 which are the respective substrates for the insulation 24-1 and the insulator coat 27, and no gap should occur upon temperature cycling. The linking insulator 30 should also have high corrosion resistance and sufficient mechanical strength. These requirements can be satisfied by a very limited number of materials. The glass-mica molded body that forms the insulators on the insulated pipe joint and the insulated pipe is one of the most suitable materials, but a problem is how to shape the glass-mica molded body into the linking insulator 30.

As a result of various studies made to solve this problem, the present inventors have succeeded in shaping the glass-mica molded body into the desired linking insulator 30. An embodiment of a method for attaining this end is described hereunder. A shaping mold unit designed expressly for the method is used. This mold unit and the shaping method using it are hereunder shown by reference to FIG. 10A and 10B.

The mold unit has a molding section formed of an upper mold 31 and a lower mold 32 positioned in a face-to-face relationship, with a center through-hole 33 provided to permit the insertion of the assembly 102 of the joint 101 welded to the insulated pipe 100, as well as an annular space 34 provided in the center to facilitate the flowing of the feed for making the linking insulator 30. The top of the upper mold 31 is provided with a filling hole 35 communicating with the space 34, whereas the lower mold 32 has a receptacle 36 at the bottom. This receptacle 36 communicates with the space 34 by a passage hole 37. The feed is filled into a mold 31. The mold 38 has a feed filling cavity 39 in the center and has a drain hole 40 in the bottom that communicates with the filling hole 35 in the upper mold 31. A plunger 41 has a shape that is fittable into the filling cavity 39. The lower mold 32 rests on a support 42. Each of the upper mold 31, lower mold 32 and filling mold 38 may be split into two parts longitudinally in order to facilitate disassembly of the mold unit after completion of the mold process. If split-type molds are used, provision must be made for preventing relative displacement of the molds during shaping under pressure.

The material used for making the linking insulator 30 is hereunder described. The glass and mica used should be the same as the ones used to form the insulators on the joint 101 and insulated pipe 100. Glass and mica powders are mixed in equal proportions (50:50 vol %) and, therefore, the proportion of the glass powder is higher than in the material for making the insulator 24 on the joint 101 and the insulator coat 27 on the insulated pipe 100. The mixed powder is wetted by addition of about 5 wt % of water, and the blend is cold-shaped with a press (not shown) into a cylindrical form that can be charged into the cavity 39. The cylinder is dehydrated to form a compact 43.

Figures 10A, 10B:
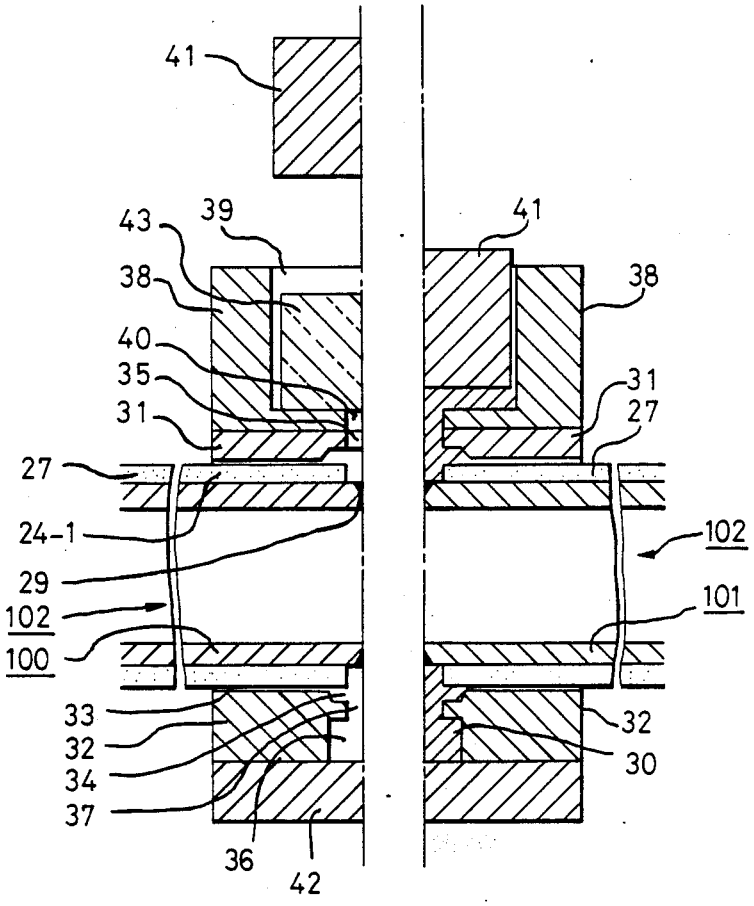

The shaping process proceeds as follows. The upper mold 31 is assembled with the support 42. In the assembly of the upper mold 31, the filling mold 38 is placed on the support 42 and lower mold 32. The plunger 41 is left free. The mold unit is heated to 450° C., the assembly 102 is heated in an annular furnace so as to increase the temperature around the weld 29 to 400° C., and the compact 43 is heated to 750° C. After completion of this heating, the assembly 102 is inserted into the through-hole 33 and retained so that the weld 29 is positioned beneath the filling hole 35. Subsequently, the compact 43 is placed within the cavity 39, as shown in FIG. 10A. The plunger 41 is placed on the compact 43 and urged with a press (not shown) against the compact 43. The pressurized compact 43 flows through the holes 40 and 35 to reach a point above the space 34, from which it is divided into two streams that flow on both sides of the assembly 102 through the space 34 and the space that is defined by the outer insulation 24-1 on the joint 101 and the insulator coat 27 on the insulated pipe 100. The two streams are combined together at the bottom of the assembly 102. The combined stream passes through the hole 37 to reach the receptacle 36. After filling the receptacle 36, the stream stops flowing and its density is increased upon further application of pressure so as to form a linking insulator 30 made of the glass-mica molded body, as shown in FIG. 10B. When the temperature of the insulator 30 has reached 400° C., the molding unit is disassembled to recover the shaped article. During the recovery step, the glass-mica molded body within the holes 35 and 37 may break, but this will cause little damage to the linking insulator 30. The other weld 29 is processed by the same procedure to form the linking insulator 30.

The thus-prepared linking insulator 30 ensures perfect insulation since it leaves no gap at the mating surface with the insulator 24-1 or insulator coat 27. The features of the method of shaping the linking insulator 30 having such perfect insulating properties are described below.

First, the method is characterized by the use of an insulating material which is a mixture of 50 vol % of a glass powder and 50 vol % of mica powder. The proportion of the glass powder is higher than in the material for making the outer insulator 24-1 and the insulator coat 27 which is made of 35 vol % of a glass powder and 65 vol % of a mica powder. The purpose of employing a higher proportion of glass powder is to ensure that the thermal expansion coefficient of the linking insulator 30 at temperatures below the glass transition point is smaller than that of the steel which makes the mating wall 21-2 and metal pipe 26. By introducing this differential thermal expansion coefficient, both lateral sides of the linking insulator 30 are urged by the adjacent insulators 24-1 and 27 during the cooling period following the molding step, and the resulting absence of gaps realizes perfect adhesion to both insulators 24-1 and 27.

The compact 43, assembly 102 and the molding unit are respectively heated to temperatures that should satisfy certain requirements. The molding unit is heated to 450° C. in order to maintain it above the glass transition point (420° C.), thereby preventing the compact 43 from cooling to solidify. However, if the compact is heated excessively, the insulators 24-1 and 27 become undesirably hot when the assembly 102 is inserted into the through-hole 33. The temperature to which the assembly 102 is heated is closely related to the glass transition point. If the assembly is heated to a temperature above the glass transition point, the insulators 24-1 and 27 swell owing to the decrease in the viscosity of the glassy material, and the resulting decrease in the density of the insulators unavoidably causes impaired insulation characteristics. If the assembly is heated to an excessively low temperature, cracks will develop in the insulators when they contact the hot fluid compact 43 under pressure. Neither swelling nor cracking will occur if the assembly is heated to a temperature slightly below the glass transition point. Therefore, the assembly is desirably heated to a temperature 20° to 40° C. below the transition point. In the embodiment shown, the assembly is heated to 400° C., which is 20° C. lower than the glass transition point of 420° C. The compact 43 must be heated to such a temperature that it has a viscosity low enough to become fluid and form a linking insulator 30 with an equal density in every part. Additionally, in order to minimize not only the thermal effects that may be caused on the insulators 24-1 and 27 but also the absolute value of the amount of thermal shrinkage, the compact is preferably heated to the lowest possible temperature and, in the embodiment shown, a temperature of 750° C. is used.

The most characteristic feature of the construction of the molding unit is the provision of the receptacle 36 with the passage hole 37 on the bottom. During the molding process, the compact 43 as pressurized by the plunger 41 passes through the holes 40 and 35 to reach a point above the space 34 which the assembly 102 forms with the upper mold 31 and lower mold 32. At this point, the flowing compact is divided into two streams that flow on both sides of the assembly 102 and combine at the lower part of the assembly. The combined stream passes through the hole 37 and ceases flowing when it completely fills the receptacle 36. Upon further application of the pressure by the plunger 41, the density of the no-longer-flowing compact 43 is increased so as to form the linking insulator 30 made of the glass-mica molded body. As already mentioned, after passing through the hole 35, the compact 43 is divided into two streams that flow on both sides of the assembly 102 and combine by impinging at the bottom of the assembly. The front of the combined stream has a lower temperature since it is flowing in contact with the inner wall of the molding unit and the outer surface of the assembly 102. For this reason, the portion of the insulator that has been formed by the two impinging streams is unable to retain a completely fused state. In the absence of the receptacle 36, such a defective insulator would form at the bottom of the assembly 102 and cause subsequent cracking, which would eventually lead to deteriorated mechanical and electrical characteristics. However, since the molding unit used in the present invention has the receptacle 36, the defective insulator will be pushed into the receptacle 36 through the hole 37 and the insulator forming at the lower part of the assembly 102 retains a completely fused state.

Figure 1:
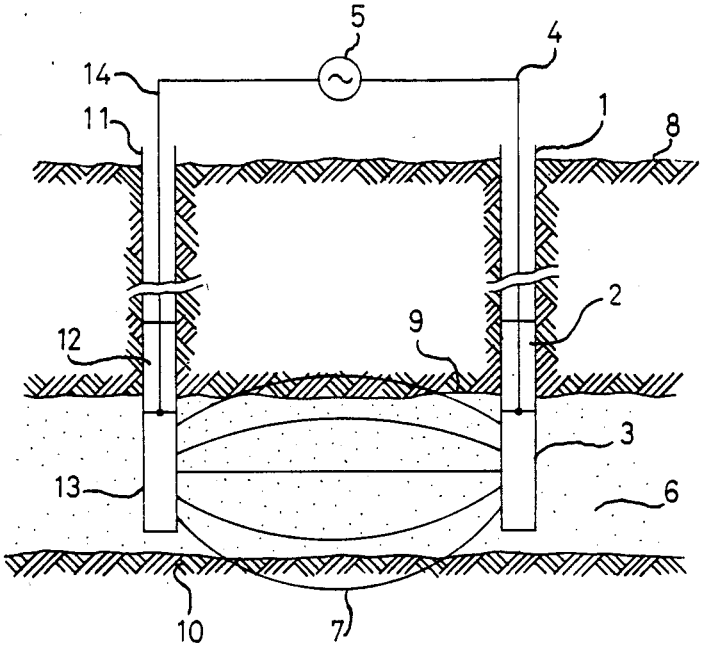
FIG. 1 PRIOR ART
FIG. 1 is a schematic cross-sectional view showing an application of a conventional electrode unit.
Figure 3A:
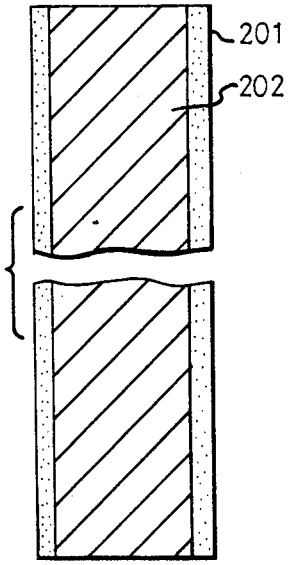
FIG. 3A PRIOR ART
Figure 3B:
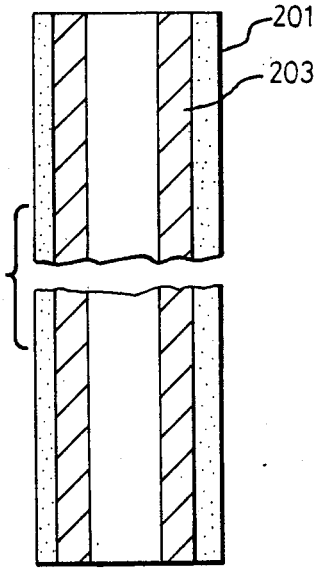
FIG. 3B PRIOR ART
Figure 11:
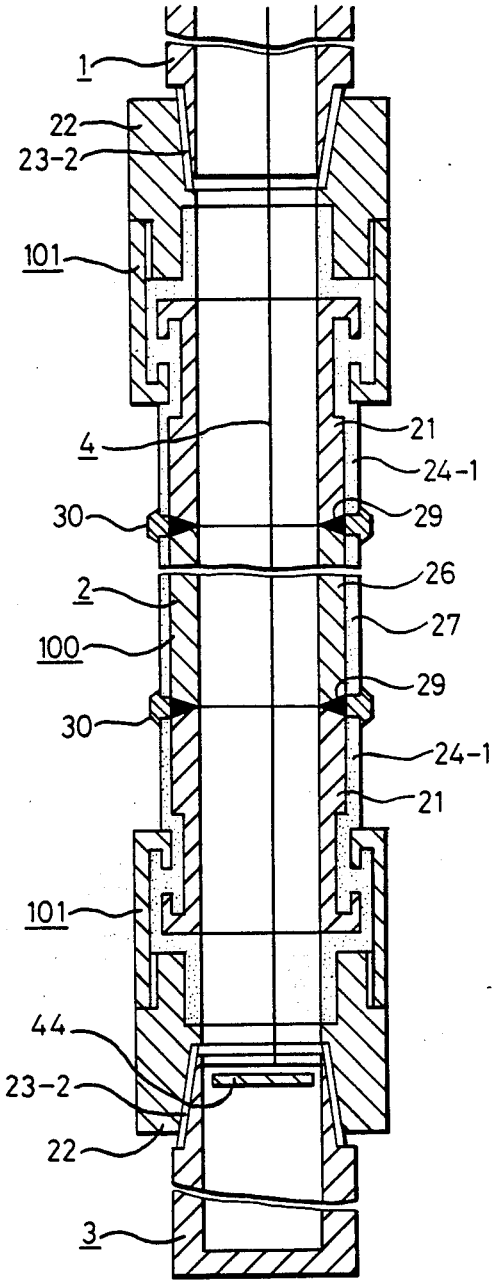
FIG. 11 is a longitudinal sectional view showing a preferred embodiment of an electrode unit constructed in accordance with the present invention.

An embodiment of the electrode unit in accordance with the present invention is hereunder shown by reference to FIG. 11, wherein reference numerals 1 to 4 designate the same components as indicated in FIG. 1. A partition 44 is placed within the electrode 3 at the top portion. The electrode unit shown has two insulated pipe joints 101; the external metal member 22 on one joint is connected by a thread 23-2 to the casing 1, and the external metal member 22 of the other joint is also connected by a thread 23-2 to the electrode 3. To each of the internal metal members 21 on the opposing joint 101 is connected the metal pipe 26 forming the base of the insulated pipe 100 by welding. This arrangement ensures perfect insulation between the casing 1 and the electrode 3. This electrode unit is also provided with the desired insulating properties on the outer surface because the gap between the outer insulator 24-1 on the pipe joint 101 and the insulator coat 27 on the insulated pipe 100 is filled with the linking insulator 30 to form a continuous insulation layer and, at the same time, both the internal metal member 21 on the joint 101 and the metal pipe 26 forming the basis of the insulated pipe 100 are entirely covered with an insulator coat made of a glass-mica molded body.

The electrode unit in accordance with the present invention depends on the insulated pipe joint for ensuring the necessary electrical insulating properties, mechanical impact strength and strength against pulling action. The surface insulating properties of the unit are ensured by the insulated pipe and the unique mechanism for linking it to the adjacent joints. The electrode unit is entirely free from the problem of low surface insulation properties that has been a fatal defect with the conventional electrode unit.

Figures 6A, 6B:
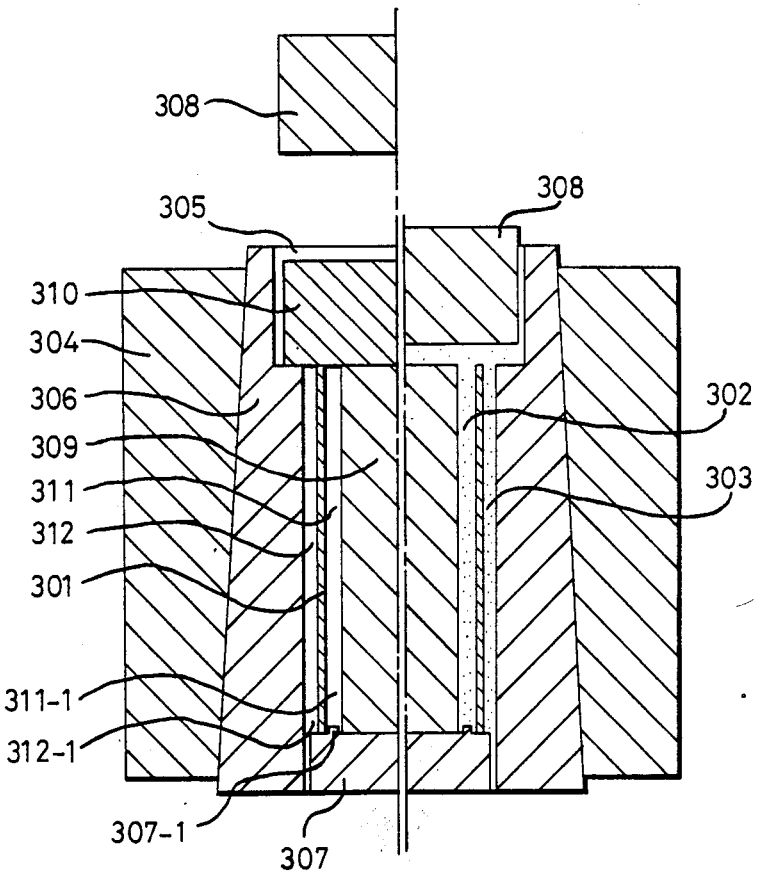
FIG. 6A PRIOR ART
FIG. 6B PRIOR ART
Figures 7B, 7C:
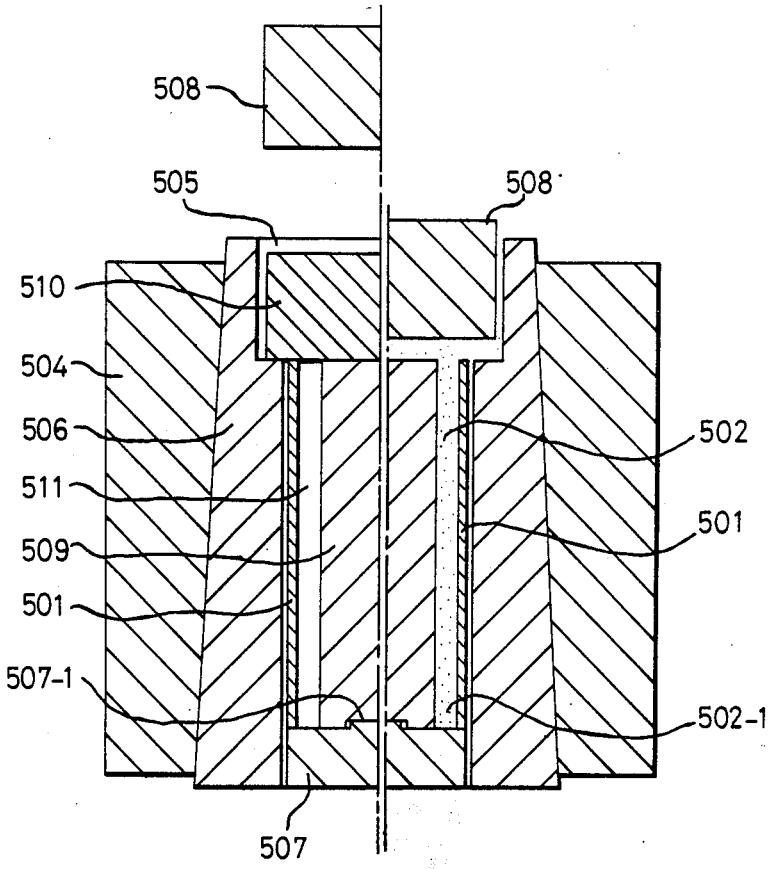
FIG. 7B PRIOR ART
FIG. 7C PRIOR ART

The embodiment shown in FIG. 6 uses two pipe joints and one insulated pipe. The number of the insulated pipes to be joined may be increased so as to provide better surface insulation on the electrode unit. In the embodiment shown, the joint 101 is connected to both the casing 1 and the electrode 3 by a threaded connection, whereas the connection to the insulated pipe 100 is provided by welding. These are not the only fastening techniques available, and other methods may be properly selected in view of ease of assembly and economical aspects.

The molding unit used in the embodiment shown above has the space 34 formed around the ends at which the pipe joint 101 is connected to the insulated pipe 100. This space is provided for the specific purpose of facilitating the flowing of the compact 34 under pressure and may be omitted if the ends at which the pipe joint is connected to the insulated pipe have a construction that allows easy flow of the compact.

As will be apparent from the foregoing description, the electrode unit in accordance with the present invention is very useful for the recovery of underground hydrocarbon resources by electrical heating, and presents great economical and technical advantages in the art.

The present invention will hereunder be further described by reference to further embodiments shown in FIGS. 12 through 15B of the drawings.

Figure 12:
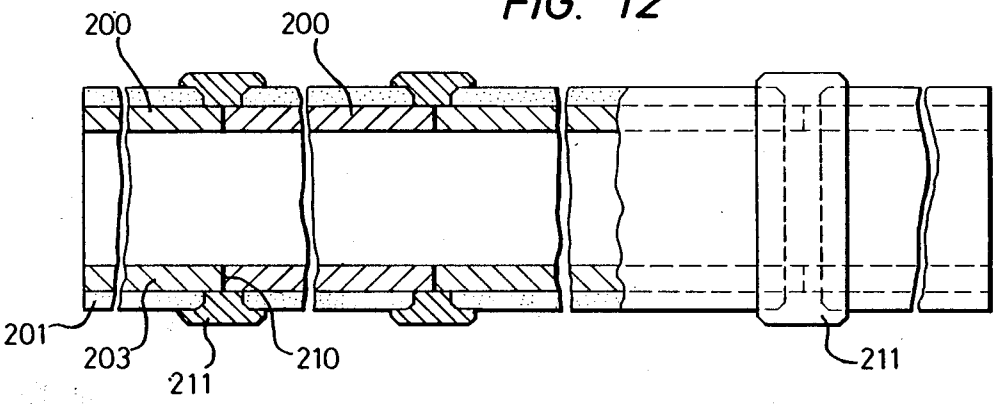
FIG. 12 shows a partial longitudinal cross section of a completed pipe.

FIG. 12 illustrates an embodiment in the form of a long insulated pipe. A plurality of short insulated pipes 100 are provided by the conventional method. Insulator coat 201 is stripped from both ends of each pipe by mechanical working to expose the metal pipe 203. Every two metal pipes 203 are connected at 210 at the exposed ends and joined together by, for example, welding, so as to produce a long insulated pipe. An insulator coat 211 formed in a band that surrounds the joined ends of the metal pipes 203; this coat not only fills the gap between two adjacent insulator coats 201 but also covers part of each insulator coat 201. The insulator coat 211 is made of a glass-mica molded body having the same characteristics as the glass-mica molded body used to form the insulator coat 201. The two insulator coats 211 are fused together completely so as to provide a continuous insulation. This is also the case for a long insulated rod that is provided in accordance with the present invention.

The long insulated pipe or rod having the construction shown above exhibits all of the advantageous properties possessed by the conventional short product: first of all, the insulator coat will not flake or peel at all even if it is subjected to temperature of about 300° C.; secondly, the insulator retains high mechanical strength in the range of room temperature up to 300° C.; the insulator is highly resistant to heat or cold and mechanical impact; the insulated pipe or rod has excellent electrical characteristics; and finally, the characteristics of the insulator do not deteriorate even if it is subjected to temperature cycling.

As will be described in detail in connection with the process for producing a long insulated cylinder of the present invention, three, four, or even more short insulated pipes 200 can be satisfactorily joined together in accordance with the present invention, and a product which is sufficiently long to meet a user's requirements can be fabricated. Furthermore, the product displays no tendency to experience any undesired change in the required characteristics.

A process for producing a long insulated pipe in accordance with the present invention is described hereunder.

Figure 13:
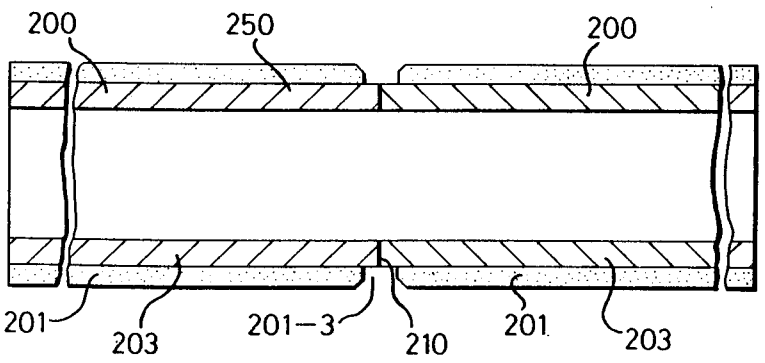
FIG. 13 is a longitudinal sectional view illustrating a first step of a process of the present invention for producing a pipe as shown in FIG. 12.

An embodiment of an insulated pipe 250 providing the basis for deposition of an insulator coat 211 will first be described with reference to FIG. 13. A plurality of short insulated pipes 200 are provided by a conventional method. Both ends of the insulator 201 formed on each pipe are stripped at 201-3 mechanical working to expose the metal pipe 203. The exposed end of one metal pipe 203 is joined 210 to the exposed end of another metal pipe by welding. The welding is most advantageously accomplished with an electron beam since this causes minimal increase in the temperature of the area around the weld including the insulator coat 201.

Figure 14B:
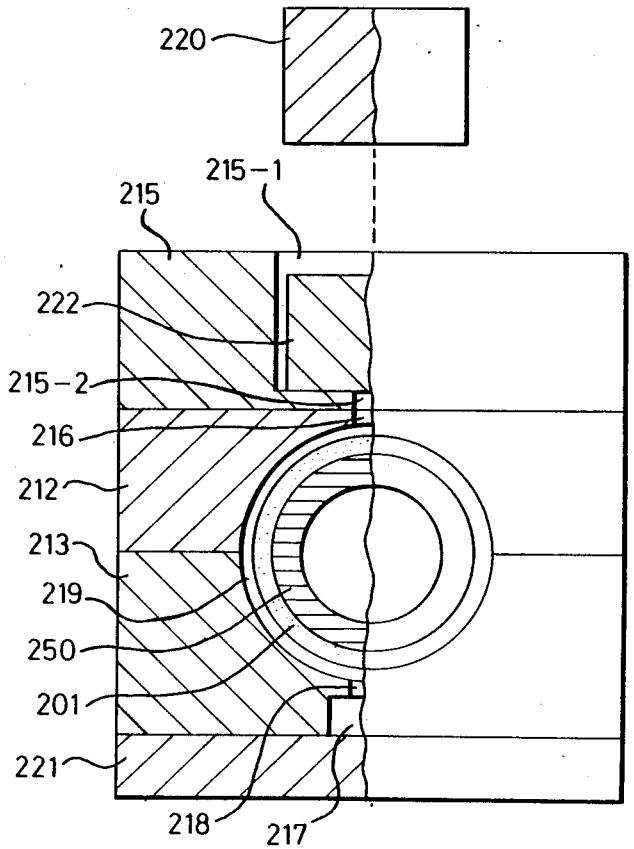
Figure 14A:
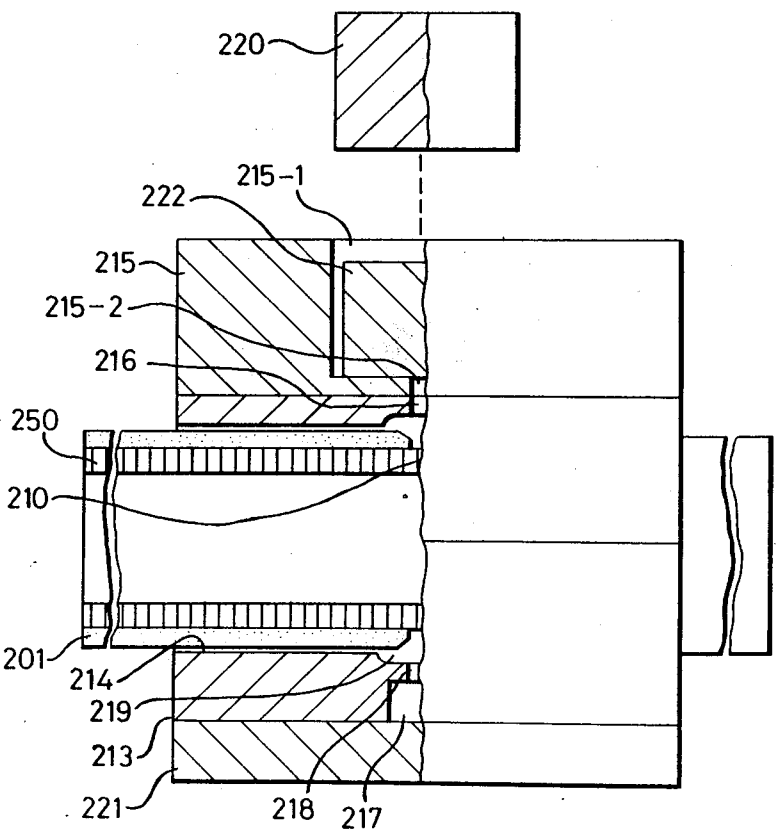

The mold unit used in shaping the insulator coat 211 is hereunder described by reference to FIGS. 14A and 14B. The mold unit has a molding section formed of an upper mold 212 and a lower mold 213 positioned in a face-to-face relationship, with a center through-hole 214 provided to permit the insertion of the base insulated pipe 250, and a space 219 provided in the center to enable the formation of the insulator coat 211. The top of the upper mold 212 is provided with a filling hole 216 communicating with the space 219, whereas the lower mold 213 has a receptacle 217 at the bottom. This receptacle 217 communicates with the space 219 by a passage hole 218. The feed is filled into a mold 215 whose lower surface contacts the upper face of the upper mold 212; the mold 215 has a feed filling cavity 215-1 in the center and has a drain hole 215-2 in the bottom that communicates with the filling hole 216 in the upper mold 212. A plunger 220 has a shape that is fittable into the filling cavity 215-1. The lower mold 213 rests on a support 221. Each of the upper mold 212, lower mold 213 and filling mold 215 may be split into two parts longitudinally in order to facilitate subsequent disassembly of the mold unit. If split-type molds are used, provision must be made for preventing the separation of the individual components during the process of shaping under pressure.

The material for forming the insulator coat 211 is hereunder described. The glass and mica should be the same as what are used in the production of the insulated pipe 200. Preferably, the glass proportion is slightly higher than in the case of making the pipe 200; for example, a mixture of 40 vol % of a glass powder and 60 vol % of a mica powder may be used. The mixed powder is wetted by addition of about 5 wt% of water, and the blend is cold-shaped with a press (not shown) into a cylindrical form that can be charged into the cavity 215-1. The cylinder is dehydrated to form a compact 222.

Figure 15B:
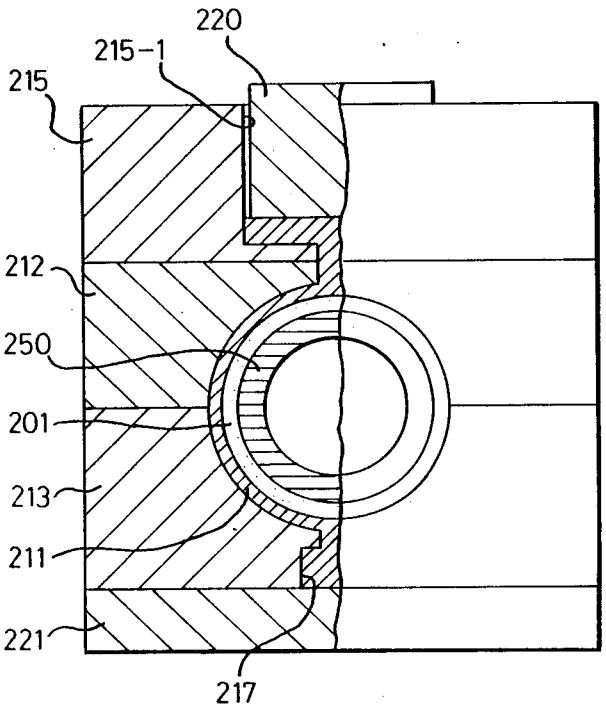
Figure 15A:
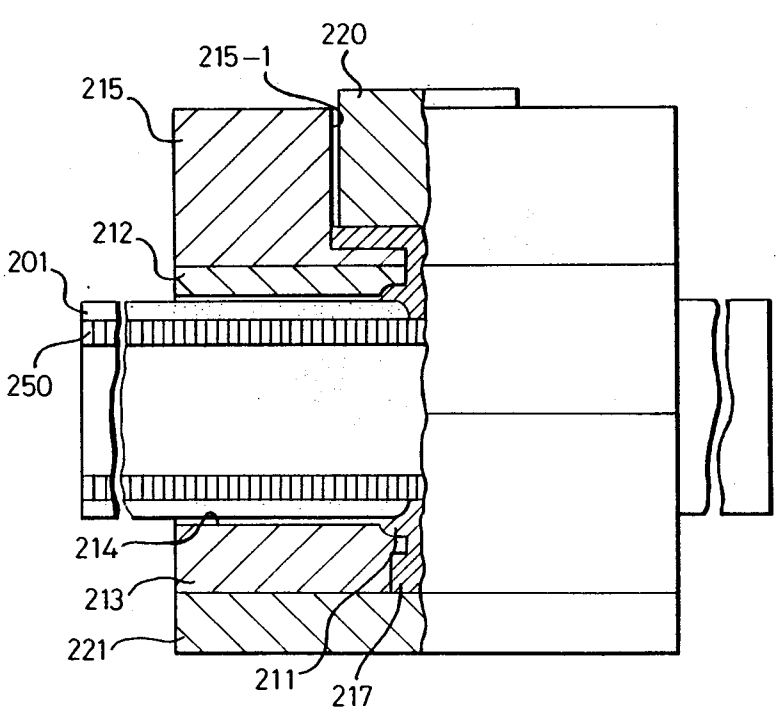

The shaping process proceeds as follows. The support 221, lower mold 213, upper mold 212 and filling mold 215 are assembled to provide an integral structure, whereas the plunger 220 is left free. The mold unit is heated to 450° C., the insulated base pipe 250 with the weld 210 to 400° C., and the compact 222 to 750° C. After completion of the heating, the base pipe 250 is inserted into the through-hole 214 and retained so that the weld 210 is positioned beneath the filling hole 216. Subsequently, the compact 222 is placed within the cavity 215-1, as shown in FIGS. 14A and 14B. The plunger 220 is placed on the compact 222 and urged with a press (not shown) against the compact 222. The pressurized compact 222 flows through the holes 215-2 and 216 to reach a point above the space 209, from which it is divided into two streams that flow on both sides of the base pipe 250 through the space 219. The two streams are combined together at the bottom of the space 219. The combined stream passes through the hole 218 to reach the receptacle 217. After filling the receptacle 217, the stream stops flowing and its density is increased upon further application of pressure so as to form an insulator coat 211 made of the glass-mica molded body, as shown in FIGS. 15A and 15B. When the temperature of the insulator coat 211 has reached 400° C., the molding unit is disassembled to recover the shaped article. During the recovery step, the glass-mica molded body within the holes 216 and 218 may break, but this will cause little damage to the obtained insulator coat 211. If necessary, the surface of the coat 211 may be polished to provide a glossy finish.

Three or four, or even more, insulated pipes 200 may be joined together by first bonding the required number of base pipes 250 and then forming an insulator coat 211 on successive welded portions 210. In this case, the entire part of the assembled base pipes 250 need not be heated at 400° C. Instead, the assembly may be placed within an annular furnace with open ends and only the connected portions 210 heated at 400° C. with the necessary temperature gradient maintained, thereby providing the required number of insulator coats 211.

The key to the method shown above for producing an insulated pipe is for the insulator coat 211 to be fully bonded to the insulator layer 201, thereby providing an integral layer that maintains perfect insulating properties. In order to satisfy this requirement, no gap should be present at the interface between the two insulation coats 211 and 207, and of course cracking must be avoided.

The features of the method of the present invention that ensure the fabrication of an insulated pipe having the requirements shown above are described below.

First, the method is characterized by using a mixture of 40 vol % of glass powder and 60 vol % of mica powder as the material for making the insulator coat 211. The proportion of the glass powder is higher than in the material for making the insulation layer 201 which consists of 35 vol % of glass powder and 65 vol % of mica powder. The purpose of employing a higher proportion of glass powder is to ensure that the insulator coat 211 made of a glass-mica molded body has a smaller thermal expansion coefficient that the insulation layer 201 at temperatures up to the glass transition point. By introducing this differential thermal expansion coefficient, both lateral sides of the insulator coat 211 are urged by the adjacent insulation layers 201 during the cooling period following the molding step, and there is no gap left at the resulting interface between the insulator coat 211 and the insulation layer 201.

The compact 222, insulated base pipe 250 and the molding unit are heated to respectively temperatures that satisfy certain requirements. The molding unit is heated to 450° C. in order to maintain it above the glass transition point (420° C.), thereby preventing the compact 222 from cooling to solidify. However, if the compact is heated excessively, the insulation layer 201 becomes undesirably hot when the base pipe 250 is inserted into the through-hole 214. The temperature to which the base pipe 250 is heated is closely related to the glass transition point. If the base pipe 250 is heated to a temperature above the glass transition point, the insulator swells owing to the decrease in the viscosity of the glassy material, and the resulting decrease in the density of the insulator will unavoidably cause impaired insulation characteristics. If the base pipe is heated to an excessively low temperature, cracks will develop in the insulator when it contacts the hot fluid compact 222 under pressure. Neither swelling nor cracking will occur if the base pipe is heated to a temperature slightly below the glass transition point. Therefore, the base pipe is desirably heated to a temperature 220° to 40° C. below the transition point. In the embodiment shown, the base pipe is heated to 400° C., which is 20° C. lower than the glass transition point of 420° C. The compact 222 must be heated to such a temperature that it has a viscosity low enough to become fluid and form an insulator coat 211 with an equal density in every part. Additionally, in order to minimize not only the thermal effects that the insulation layer 201 may be subjected to but also the absolute value of the amount of thermal shrinkage, the compact is preferably heated to the lowest temperature possible and, in the embodiment shown above, a temperature of 750° C. is used.

The most characteristic feature of the construction of the molding unit is that it has the receptacle 217 with the passage hole 218 formed on the bottom of the lower mold 213. During the molding process, the compact 222, pressurized by the plunger 220, passes through the holes 215-2 and 216 to reach a point above the space 219 which the insulated base pipe 250 forms with the upper mold 212 and the lower mold 213. At this point, the flowing compact is divided into two streams that flow on both sides of the pipe 250 and combine at the lower part thereof. The combined stream passes through the hole 218 and ceases flowing when it completely fills the receptacle 217. Upon further application of pressure by the plunger 220, the density of the no-longer-flowing compact 222 is increased so as to form the insulator coat 222 made of the glass-mica molded body. As already mentioned, after passing through the hole 216, the compact 222 is divided into two streams that flow on both sides of the base pipe 250 and combine by impinging at the bottom of that pipe. The front of the combined stream has a lower temperature since it is flowing in contact with the inner wall of the molding unit and the outer surface of the base pipe 250. For this reason, the portion of the insulator that has been formed by the two impinging streams is unable to retain a completely fused state. In the absence of the receptacle 217, such a defective insulator would form at the bottom of the base pipe 250 and cause subsequent cracking, which would eventually lead to deteriorated mechanical and electrical characteristics. However, since the molding unit used in the present invention has the receptacle 217 and the passage hole 218 communicating therewith, the defective insulator will be pushed into the receptacle 217 through the hole 218 and the insulator forming at the lower part of the pipe 250 retains a completely fused state.

For the reason shown above, the insulator coat 211 shaped in accordance with the present invention has no possibility of cracking. Furthermore, the molten compact 222 flows a distance which is far shorter than is required in the conventional method, and therefore the resulting insulator coat 211 has a very uniform density distribution.

The foregoing embodiment concerns the production of an insulated pipe, but it should be understood that the process of the present invention is equally applicable to the production of an insulated rod. The cross section of the tubing that is produced in accordance with the present invention may be circular or rectangular.

As will be readily understood from the foregoing description, the process of the above-described embodiment of the present invention enables the production of an insulated metal tubing (either pipe or rod) having a considerable length that has been unobtainable by the conventional techniques. Additionally, this long insulated tubing has the good characteristics possessed by the existing short products: first, it is completely protected against cracking; secondly, it retains high mechanical strength and good electrical characteristics in the range of room temperature up to 300° C.; thirdly, it exhibits long-term reliability without suffering from deteriorated characteristics due to time-dependent changes. The long insulated tubing according to the present invention finds much utility as a component having consistent characteristics and will contribute to the provision of smaller machines and equipment having improved performance. Therefore, the present invention is expected to offer great economical and technical advantages in the art.

Figures 16A, 16B:
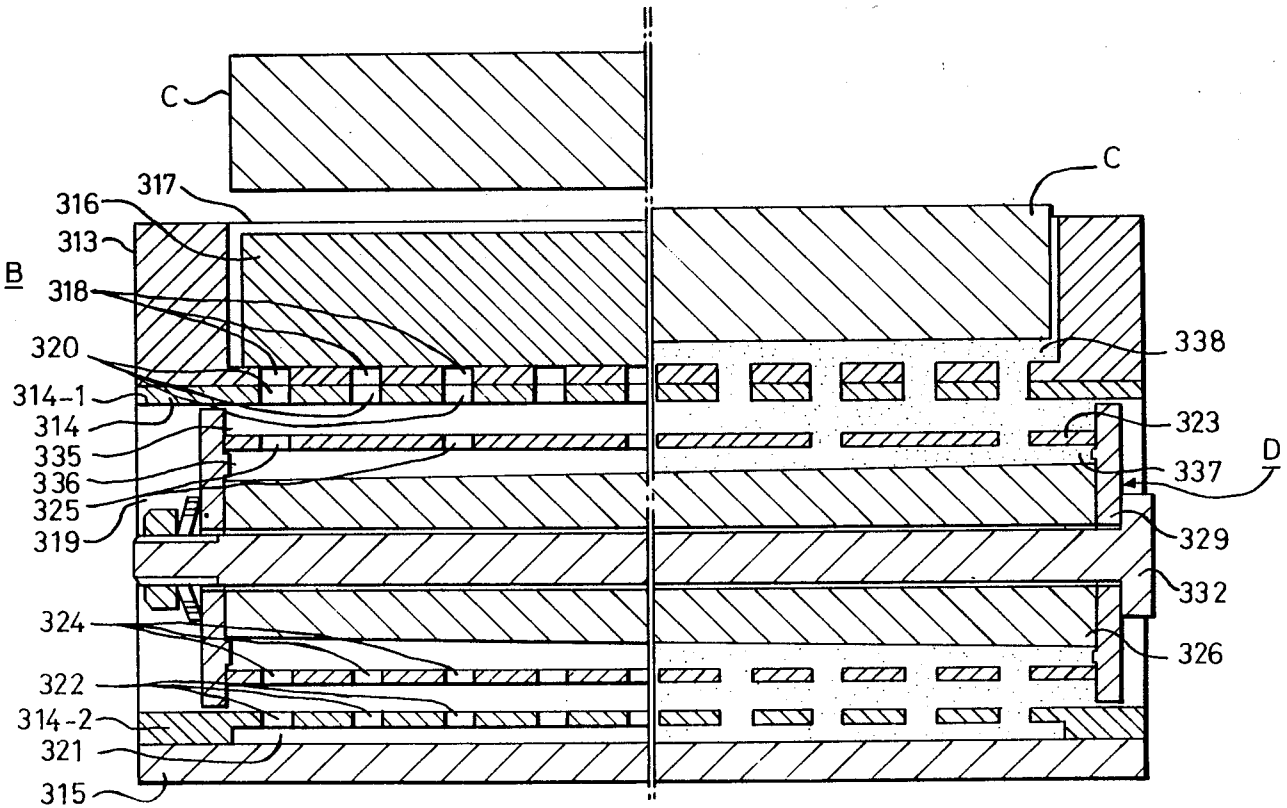
Figures 17A, 17B:
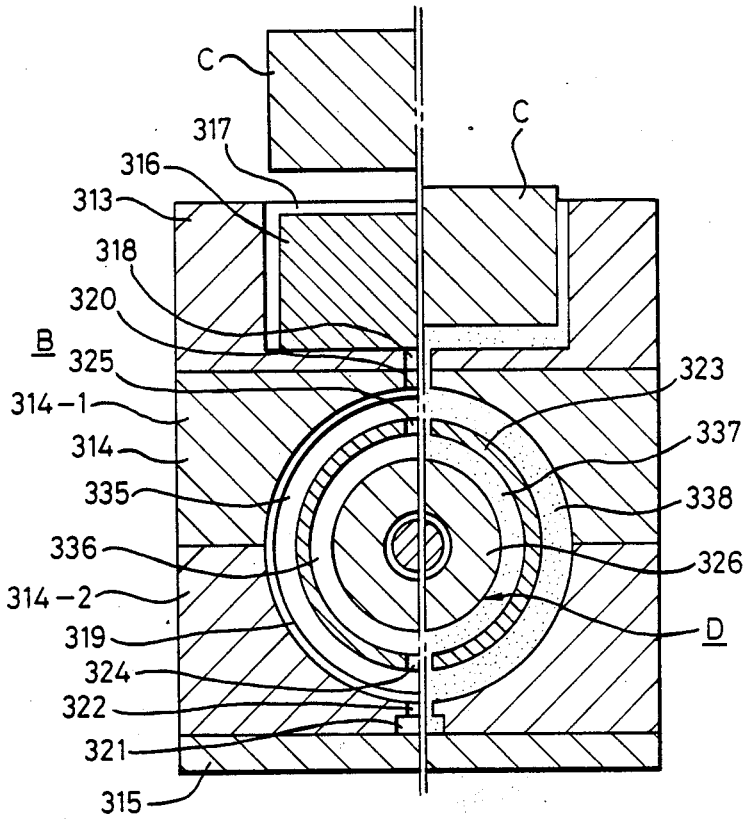
FIG. 17A and 17B are cross-sectional views corresponding to FIG. 16A and 16B, respectively.

Another shaping mold unit used in implementing the process of the present invention is hereunder described with reference to FIGS. 16A and 17A. The mold unit consists of a molding section B and a plunger C. The molding section B is an assembly of three components, an upper mold 313, a lower mold 314 divided into an upper part 314-1 and a lower part 314-2, and a support 315. The mating surfaces of each component are sealed against the outflow of a pressurized compact 316. The upper mold 313 is provided with a parallel-piped feed-filling cavity 317 at the top and a plurality of elongated drain channels 318 of a circular cross section at the bottom. The drain channels 318 extend from the bottom of the filling cavity 317 through the upper mold 313. In the embodiment shown in FIG. 16A, nine drain channels 318 are provided. The upper part 314-1 and lower part 314-2 of the lower mold 314 are in contact with each other so that their mating surfaces form an imaginary plane that cuts through the center of a through-hole 319 extending in the transversal direction of the lower mold 314. The upper part 314-1 is provided with a plurality of filling channels 320 that establish communication between the drain channels 318 in the upper mold 313 and the through-hole 319. The number and shape of the filling channels 320 are identical to those of the drain channels 318. The lower part 314-2 of the lower mold 314 is provided with a rectangular receptacle 321, above which are provided a plurality of elliptical passage channels 322 extending to the throughhole 319. In the embodiment shown in FIGS. 16A and 16B, nine passage channels 322 are provided.

The support 315 is placed under the lower mold 314 and provides a bottom surface for the receptacle 321 while holding the upper mold 313 and lower mold 314 in position. The plunger C has a shape that is fittable into the feed-filling cavity 317.

Figure 18:
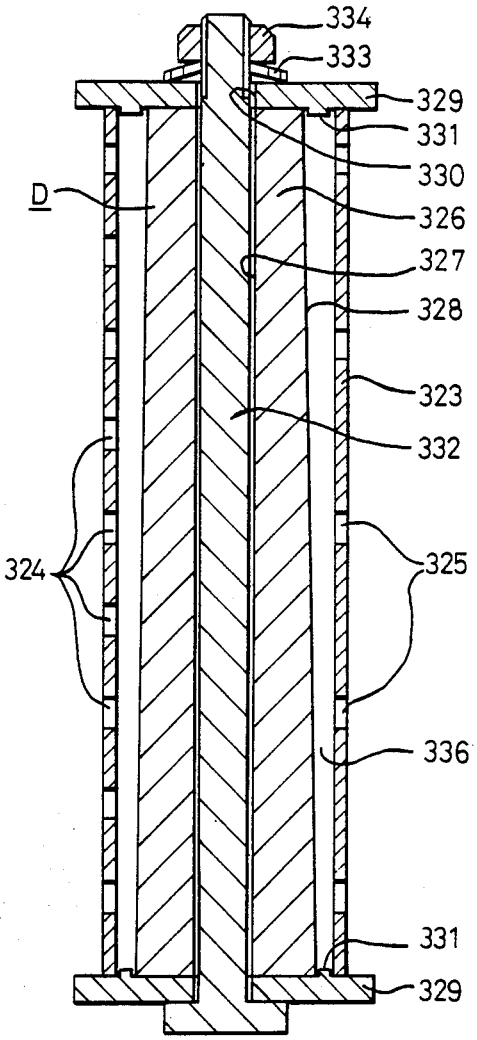
FIG. 18 shows a longitudinal sectional view of a shaping jig used in the process illustrated in FIGS. 16A through 17B.

A shaping jig, generally indicated at D in FIG. 18, is used to retain the metal pipe 323 and is hereunder described by reference to FIG. 18. The metal pipe 323 has an outside diameter smaller than the inside diameter of the through-hole 319 in the shaping mold unit. A plurality of outflow channels 324 are provided in the wall of the metal pipe 323 in such a manner that they face the passage channels 322 in the lower mold 314. The number of the outflow channels 324 is equal to that of the passage channels 322. Diametrically opposed to these outflow channels 324, inflow channels 325 are also provided in the wall of the metal pipe 323 so that they face the filling channels 320. In the embodiment shown, nine outflow channels 322 and five inflow channels 325 are provided. The metal pipe 323 may be made of any material that has a mechanical strength sufficient to withstand pressurization under heating up to a temperature of about 500° C. A steel pipe is used advantageously.

An insert 326 has a center hole 327 and a tapered outer surface 328 whose thicker portion has an outside diameter smaller than the inside diameter of the metal pipe 323. The insert 326 is made of a material having a thermal expansion coefficient (the term "thermal shrinkage coefficient" is actually more appropriate in the case concerned, but for the sake of convenience, the term "thermal expansion coefficient" is used hereunder) greater than the thermal expansion coefficient of the glass-mica molded body at a temperature not higher than the transition point of the glass in the glass-mica molded body. As such material, stainless steel or copper alloys are used advantageously. The shaping jig D also has side plates 329 each having an outside diameter that is fittable into the through-hole 319 in the shaping mold unit. Each of the side plates 329 has a center hole 330, and a projection 331 that ensures the centering of the metal pipe 323 and insert 326. There is not a particular limitation on the material for the side plates 329. A bolt 332, screwed into the jig D, is made of a material having a thermal expansion coefficient smaller than that of the glass-mica molded body. Titanium is advantageously used. A washer 333, seated one of the two side plates 330, may be of any desired type such as a Belleville spring or spring washer. The purpose of this washer is to permit the assembly of the insert 326 and metal pipe 323 without causing excessive clamping pressure. The bolt 332 engages a nut 334.

The shaping jig D shown above is used after assembling the insert 326 and metal pipe 323 in the central position, as illustrated in FIG. 18.

The fabrication of a corrosion-resistant pipe in accordance with the present invention proceeds as follows: The feed is the same as what is used in the conventional method. First, a compact 316 capable of being charged into the filling cavity 317 is prepared. Then, the assembled shaping section B and the plunger C are heated to 550° C., the shaping jig D to 500° C., and the prepared compact 316 to 800° C. After completion of heating, the shaping jig D having the metal pipe 323 held in position is inserted into the through hole 319 in the lower mold 314 in such a manner that the inflow channels 325 face the filling channels 320 and the outflow channels 324 face passage channels 322. Subsequently, the compact 316 is charged into the filling cavity 317, as shown in FIG. 16A and FIG. 17A.

In the next step, the plunger C is placed on the compact 316 and urged with a press (not shown) against the compact 316 so that it flows. The flowing compact 316 passes through the drain channels 318 and filling channels 320 to reach a space 335 defined by the walls of metal pipe 323 and side plates 329 (as retained in the jig D) and the through-hole 319. Part of the compact 316 passes through the inflow channels 325 to reach a space 336 defined by the insert 326, side plates 329 and the metal pipe 323. The flowing compact 316 proceeds further and is divided into two streams that flow on both sides of the metal pipe 323 and insert 326, filling the spaces 335 and 336. One pair of streams that have been forced down through the space 336 is combined below that space. The front of the combined stream passes through the drain channels 324 and the space 335 and flows down through the passage channels 322 to reach the receptacle 321. The other pair of streams that has been forced down through the space 335 is combined below that space. The front of the combined stream flows down through the passage channels 322 to reach the receptacle 321, and after filling this receptacle, the stream stops flowing. Upon further application of pressure by the plunger C, the density of the compact 316 is increased so as to provide the metal pipe 323 with an inner coat 337 and an outer coat 328 which are both made of the glass-mica molded body. The metal pipe 323 with the so formed inner coat 337 and outer coat 338 is shown in FIG. 16B and FIG. 17A.

Figures 19A, 19B:
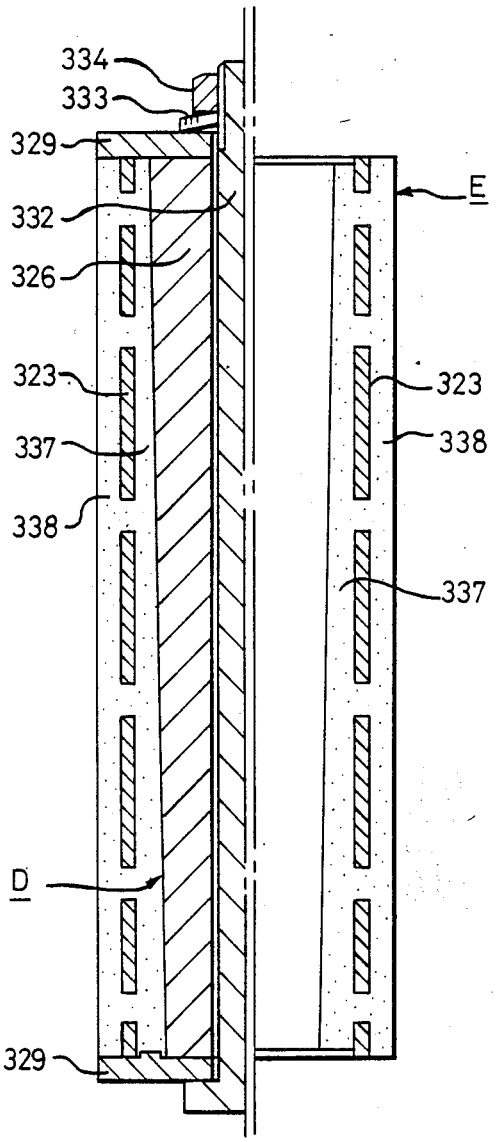

Thereafter, the molding unit is cooled until the temperature of the two coats 337 and 338 reaches 380° C., whereupon the cooled molding unit is disassembled to recover the shaped article. Thin sheets that may have formed in the filling channels 320 and passage channels 322 are removed by breaking. As a result, the shaped article shown in FIG. 19A is obtained together with the shaping jig D. The nut 334 is then loosened for removing the washer 333, side plates 329 and bolt 332. The insert 326 has a higher thermal expansion coefficient than the inner coat 337 at a temperature up to 400° C., i.e., the transition point of the glass in the glass-mica molded body. Therefore, the insert 326 shrinks in both circumferential and axial directions so as to produce a small gap between the outer surface of the insert 326 and the inner surface of the inner coat 337. Additionally, the insert 326 has a tapered surface 328. Therefore, the insert 326 can be readily removed so as to produce a complete corrosion-resistant pipe E as shown in FIG. 19B.

The features of the process of this embodiment of the present invention and the corrosion-resistant pipe produced by this process are shown hereunder. In accordance with the process of this embodiment of the present invention, the heated compact 316 flows only a short distance and suffers a very small temperature drop. Therefore, this process is entirely free from the defect with the conventional method, i.e., the undesirably low density in the coat that is farthest from the area in contact with the plunger. This advantage is particularly great since the front of the flowing compact 316 is forced into the receptacle 321 provided in the bottom of the molding unit. When the compact 316, having passed through the drain channels 318 and filling channels 320, reaches a point above the metal pipe 323, it is divided into two streams that flow on both sides of the metal pipe 323 and are combined together. The combined stream has a lower temperature but is forced into the receptacle 321 through the passage channels 322. The part of the compact 316 that has flowed through the inflow channels 325 after passing through the drain channels 318 and filling channels 320 reaches a point above the insert 326, from which the compact is divided into two streams that flow on both sides of the insert 326 and are combined together by below that insert. The combined stream flows through the outflow channels 324, the space 335 and the passage channels 322 to reach the receptacle 321. Therefore, the resulting inner coat 337 and outer coat 338 contain no part that has undergone a temperature drop; instead, both coats have a uniform density distribution and exhibit consistent characteristics.

As described above, it is most important for the purpose of the present invention that the shaping mold unit have at its bottom the receptacle 321 and for the front of the flowing compact 316 that has experienced a temperature drop during its flow to be pushed into this receptacle 321 so as to introduce no inhomogeneous density distribution in the final product.

Theoretically, the conditions for deposition of the coats 337 and 338 do not vary even if the length of the corrosion-resistant pipe E is increased, and therefore a long corrosion-resistant pipe can be fabricated by the process of the present invention, barring problems involved in the removal of the insert 326. Such problems relate to the shaping jig D and can be solved by meeting the following requirements. First, the insert 326 should have as great a difference as possible in thermal expansion coefficient from the glass-mica molded body. Secondly, the slope of the tapered surface 328 should be increased. Thirdly, any adhesion of the insert 326 to the inner coat 337 should be avoided. If the slope of the taper 328 is increased, there occurs a difference in thickness between the inner coat on one end of the metal pipe and that on the other end. However, this is not a serious problem because, after molding, the inner surface of the thicker portion of the coat can be trimmed by mechanical working so as to provide a corrosion-resistant pipe having the inner coat of a uniform thickness.

An effective way to avoid adhesion between the insert 326 and the inner coat 337 is by using a copper alloy as the material of the insert 326. During heating, a copper oxide film will form on the insert 326 made of a copper alloy, and this oxide film has little adhesion to the base metal and effectively works as a release agent. Another effective method is by applying a copper plating on the surface of the insert 326.

The bolt 332 in the shaping jig D is made of a material having a small thermal expansion coefficient. The washer 333 is used to minimize the clamping pressure of the nut 334, which is done for the purpose of preventing the side plates 329 from applying a clamping pressure on the coats 302 and 303 during the cooling period following the molding step.

The corrosion-resistant pipe fabricated by the process shown above in accordance with this embodiment of the present invention has coats that are formed of a glass-mica molded body with a high proportion of a mica powder having an extremely high degree of corrosion resistance. Therefore, the coats on the pipe exhibit very good insulation characteristics, as well as very strong resistance to hot water, acids and brine. Additionally, the coats have a thermal expansion coefficient close to that of the metal pipe, and, even if they are subjected to temperatures as high as 200° to 300° C., the coats will not deform and will ensure perfect bonding to the metal pipe. Furthermore, the coats are gas impermeable and cause no leakage problems. Finally, the coats have a very high resistance to cold or heat and to mechanical impact. Therefore, the corrosion-resistant pipe produced by the process of the present invention retains characteristics comparable to those of the product obtained by the prior art technique while enabling the fabrication of a long pipe, which is unobtainable by any conventional method. In short, the process of the present invention eliminates all the defects that have been considered unavoidable in the prior art.

The foregoing described concerns a corrosion-resistant pipe that has high mechanical strength and good insulating properties and which can be used for conveying highly metal-corrosive gases or liquids at high temperatures of 200° to 300° C. However, the use of the pipe fabricated by the present invention is not limited to such conveying pipes and it may also be used for pipes intended for service at temperatures between room temperature and 300° C., or under temperatures cycling between the two extremes. Because of the extent of its applications, the pipe in accordance with the present invention offers great advantages in both practical and technical aspects. Another advantage relates to economy and the intended corrosion-resistant pipe can be produced at a very low cost.

Figure 21:
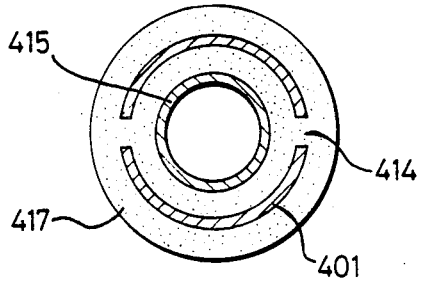
FIG. 21 is a cross-sectional view taken along a line IV—IV in FIG. 20.
Figure 20:
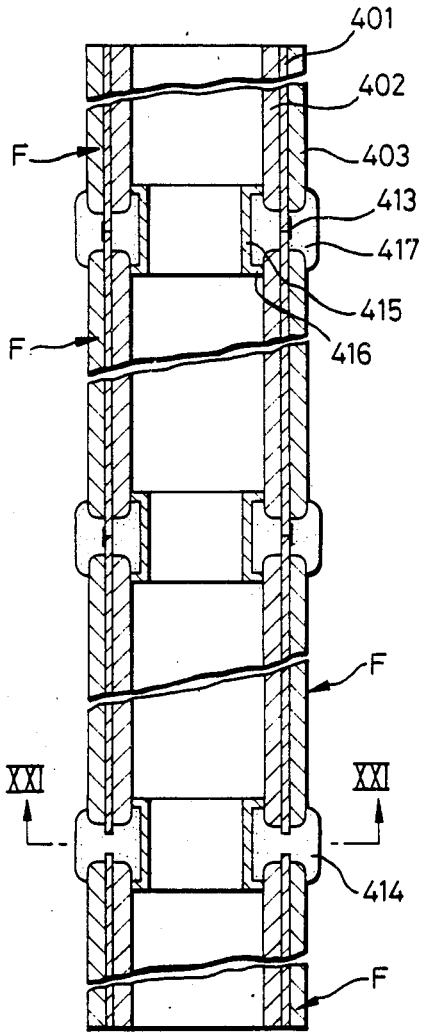
FIG. 20 shows a partial longitudinal sectional view of a corrosion-resistant pipe constructed in accordance with the invention.

The construction of another embodiment of a long corrosion-resistant pipe according to the present invention will hereunder described by reference to FIGS. 20 and 21. In these figures, a short corrosion-resistant pipe as produced by the conventional method is indicated at F. The inner coat 402 and outer coat 403 forming the first coat are removed from both ends of each pipe by mechanical working to expose the metal pipe 401. The exposed metal pipes 401 are interconnected at a joint 413 by welding its entire circumference so as to provide a long unit. A plurality of communication holes 414 are provided in the joint 413. An inner ring 415 with a flange 416 at both ends is inserted at the joint 413 so that the outer circumference of the flange 416 is fitted to the inner circumference of the inner coat 402. The inner ring 415 is made of a metal. A linking coat 417 that provides the second coat and which is made of a glass-mica molded body is formed as a band that fills, through the communication holes 414, the gap that is defined by the inner coat 402 and and outer coat 403 on both the inner and outer surfaces of the metal pipe 401 at the joint 413. This band also covers part of the inner surface of the inner coat 402 and the outer surface of the outer coat 403. The inner ring 415 remains on the inner surface of the linking coat 417. This linking coat 417 is completely fused with the inner coat 402 and outer coat 403 so as to form an integral coat.

A corrosion-resistant pipe that has the construction shown above can be manufactured as a long product while retaining the good corrosion resistance and other excellent properties of the short pipe produced by the prior art method. This is, the corrosion-resistant coat will not spall or peel at all even if it is subjected to temperatures of about 300° C. Secondly, the coat retains high mechanical strength in the range of room temperature up to 300° C. Also, the coat is highly resistant to heat or cold and mechanical impact, the pipe retains high electrical characteristics, and finally, the characteristics of the coat do not deteriorate even if it is subjected to temperature cycling.

In the embodiment shown, four units of the conventional short corrosion-resistant pipes F are connected. As will be shown in the subsequent description of the process of the present invention, there is no limit on the number of the short corrosion-resistant pipe F that can be joined together and a corrosion-resistant pipe of any practical desired length can be fabricated in accordance with the present invention.

Figure 22:
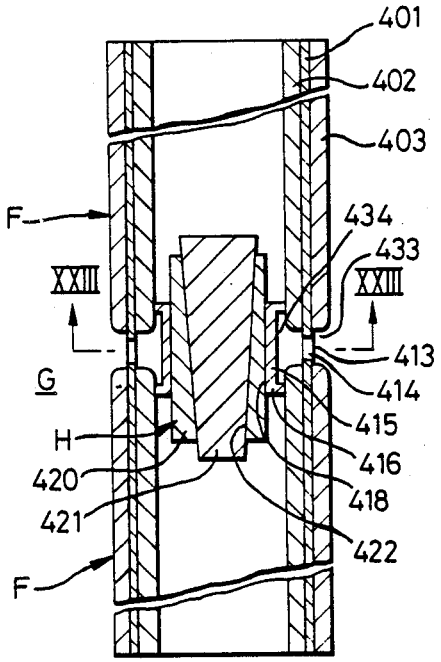
FIG. 22 is a longitudinal sectional view illustrating a preferred embodiment of the base of a corrosion-resistant pipe element for use in the production of a pipe of the invention.

A process for producing a long corrosion-resistant pipe in accordance with the present invention is hereunder described. First, the preliminary steps that precede the formation of the linking coat 417 are described by reference to FIGS. 22 and 23, wherein a short corrosion-resistant pipe as produced by the conventional method is indicated at F. The inner coat 402 and outer coat 403 are removed from both ends of each pipe F by mechanical working to expose the metal pipe 401. The exposed metal pipes 401 are interconnected at a joint 413 by welding along the entire circumference of the joint. The welding is most effectively accomplished with an electron beam since such causes a minimum increase in the temperature of the area around the weld. A plurality of communication holes 418 are then provided on the opposite sides of the joint 413. The metallic inner ring 415 has a through-hole 418 in the center and a flange 416 at both ends. The flange 416 has an outer circumference that fits with the inner circumference of the inner coat 402. A reinforcing jig generally indicated at H is composed of a split metal member 420 and a core rod 421. The metal member 420 has an outside diameter equal to the inside diameter of the through-hole 418 in the inner ring 415. The member 420 has a tapered hole 422 in the center and is split into a plurality of spaced segments. The core rod 421 has a tapered hole 422 in the split metal member 420. The inner ring 415 is inserted into the connected pipe units F. Thereafter, the reinforcing jig H is fitted into the through-hole 418 so that the inner ring 415 will not deform when a linking coat 417 is formed at the joint of the pipes F. The assembly of the joined pipes F, inner ring 415 and the reinforcing jig H provides a base corrosion-resistant pipe element G.

The shaping mold unit used for providing the linking coat 417 will hereunder be described with reference to FIGS. 24A, 24B, 25A and 25B.

The shaping mold unit is composed of an upper mold 423 and a lower mold 424 that engage each other in a contact relationship so as to form a shaping section. This shaping section has a transversal hole 425 through which the base pipe element G is inserted, as well as a center space 426 capable of forming the linking coat 417. The upper and lower molds contact each other so that their mating surfaces form an imaginary plane that cuts through the center of the transversal hole 425. The upper mold 423 has in its top a filling hole 427 communicating with the space 426. The lower mold has in its bottom a receptacle 428 and a passage hole 429 that establishes communication between the receptacle 428 and the space 426. A feed-filling mold 430 placed on the upper mold 423 has a feed-filling cavity 405 in the center. The cavity 405 communicates with the filling hole 427 in the upper mold 423 through a drain hole 431. A plunger 408 has a shape that fits with the inner wall of the filling cavity 405. The lower mold 424 rests on a support 432.

The material for making the linking coat 417 is hereunder described. The glass and mica should be the same as what are used in the production of the corrosion-resistant pipe F. Preferably, the glass proportion is slightly higher than in the case of making the pipe F. For example, a mixture of 55 wt % of a glass powder and 45 wt % of a mica powder is used advantageously. The mixed powder is wetted by addition of about 5 wt % of water, and the blend is cold-shaped with a press (not shown) into a cylindrical form that can be charged into the cavity 405. The cylinder is dehydrated to form a compact 410.

Figures 25A, 25B:
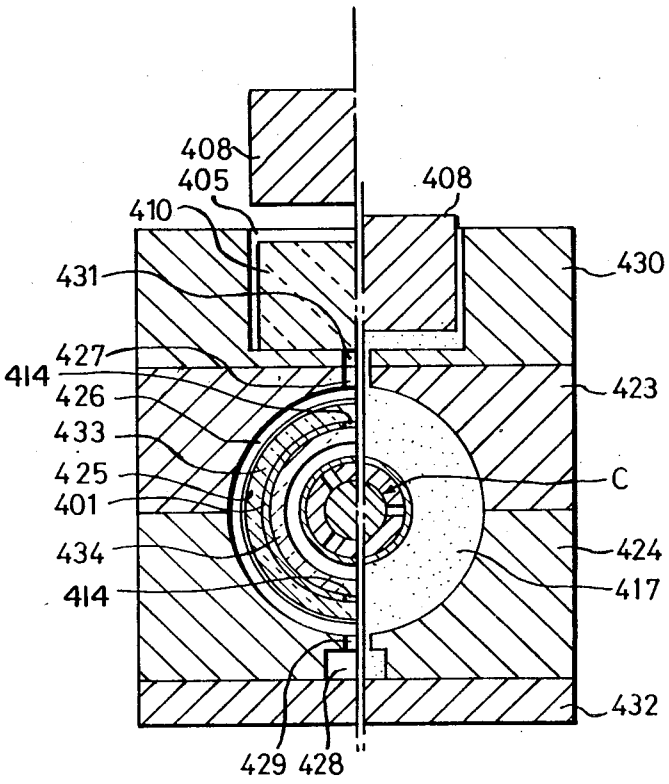
FIGS. 25A and 25B are cross-sectional views corresponding to FIGS. 24A and 24B, respectively.
Figures 27A, 27B:
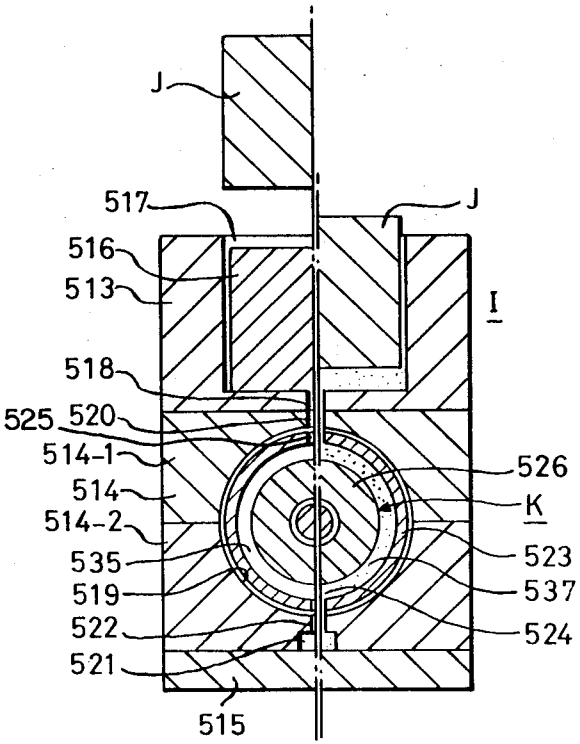
FIGS. 27A and 27B are cross-sectional views corresponding to FIGS. 26A and 26B, respectively.

The shaping process proceeds as follows. The support 432, lower mold 424, upper mold 423, and feed-filing mold 430 are assembled to provide an integral structure, whereas the plunger 408 is left free. The mold unit is heated to 450° C., the base pipe element G to 390° C. and the compact 410 to 750° C. After completion of the heating, the base pipe element G is inserted into the hole 425 as defined by the upper mold 423 and lower mold 424, and is held so that the communication holes 414 are positioned beneath the filling hole 427. Subsequently, the compact 410 is placed within the cavity 405, as shown in FIG. 24A and FIG. 25A.

In the next step, the plunger 408 is placed on the compact 410 and urged with a press (not shown) against the compact 410. The pressurized compact 410 flows through the holes 431 and 427 to reach a point above the space 426. Part of the flowing compact 410 is divided into two streams that flow on both sides of the metal pipe 401 to pass through the space 426 and the first gap 433, and impinge against each other to be combined beneath the space 426. The other part of the flowing compact passes through the communication holes 414 and is divided into two streams that flow on both sides of the inner ring 415 to pass through the second gap 434, and are combined together beneath the gap 434 by impingement. The combined stream coming from the second gap 434 passes through the lower communication hole 414 and the first gap 433, whereas the combined stream coming from the first gap 433 immediately flows down through the passage hole 429 to reach the receptacle 428. After filling the receptacle 428, the stream of compact 410 stops flowing and its density is increased upon further application of pressure so as to form a linking coat 417 made of the glass-mica molded body, as shown in FIG. 24B and FIG. 25B. When the temperature of the linking coat 417 has dropped to 380° C., the molding unit is disassembled to recover the shaped article. During the recovery step, the glass-mica molded body within the holes 427 and 429 may break, but this will cause little damage to the linking coat 417. If necessary, the surface of the coat 417 may be polished to provide a glossy finish.

The reinforcing jig H is then removed by simply loosening the core rod 421. The inner ring 415 may be left intact if it does not cause any adverse effects during actual service. Otherwise, the ring 415 may be removed by mechanical working.

If a particularly long corrosion-resistant pipe is desired, the required number of short pipes F can be joined together and a linking coat 417 is then formed on successive welded portions 413. In this case, the entire part of the base pipe element G need not be heated at 390° C. Instead, the element may be placed within an annular furnace with open ends and only the connected portions 413 heated to 390° C. with the necessary temperature gradient maintained, thereby providing the required number of linking coats 417.

The key to the method discussed above for producing a long corrosion-resistant pipe is that the linking coat 417 formed is fully bonded to the inner coat 402 and outer coat 403, thereby providing an integral layer that maintains essentially perfect corrosion-resisting properties. In order to satisfy this requirement, no gap should be present at the interface between the linking coat 417 and the inner coat 402 or outer coat 403, the occurrence of cracking must be avoided. The features of the method of the present invention that ensure the fabrication of a long corrosion-resistant pipe having the requirements shown above are described below.

First, the method is characterized by using a mixture of 55 wt % of glass powder and 45 wt % of mica powder as the material for making the linking coat 417. The proportion of the glass powder is higher than in the material for making the inner coat 402 and outer coat 403, which consists of equal weights of the glass and mica powders. The purpose of employing a higher proportion of glass powder is to ensure that the linking coat 417 made of a glass-mica molded body has a smaller thermal expansion coefficient than the inner coat 402 and outer coat 403 at temperatures up to the glass transition point. By introducing this differential thermal expansion coefficient, both lateral sides of the linking coat 417 are pressed upon by the adjacent inner coat 402 and outer coat 403 during the cooling period following the molding step, and thus the resulting interface between the linking coat 417 and the inner coat 402 or outer coat 403 has no remaining gap.

The compact 410, base pipe element G and the molding unit are heated to respectively temperatures that should satisfy certain requirements. The molding unit is heated to 450° C. in order to maintain it above the glass transition point (420° C.), thereby preventing the compact 410 from cooling to solidify. However, if the compact is heated excessively, the inner coat 402 and outer coat 403 become undesirably hot when the base pipe element G is inserted into the hole 425. The temperature to which the base pipe element G is heated is closely related to the glass transition point. If the base pipe element G is heated to a temperature above the glass transition point, the corrosion-resistant coats swell owing to the decrease in the viscosity of the glassy material, and the resulting decrease in the density of the coats will unavoidably cause impaired anti-corrosive characteristics. If the base pipe element G is heated to an excessively low temperature, cracks will develop in the coats 402 and 403 when they contact the hot fluid compact 410 under pressure. Neither swelling nor cracking will occur if the base pipe element G is heated to a temperature slightly below the glass transition point. Therefore, the base pipe element G is desirably heated to a temperature 20° to 40° C. below the transition point. In the embodiment shown, the base pipe element G is heated to 390° C., which is 30° C. lower than the glass transition point of 420° C.

The compact 410 must be heated to such a temperature that it has a viscosity low enough to become fluid and form a linking coat 417 with an equal density in every part. Additionally, in order to minimize not only the thermal effects that may be caused on the inner coat 402 and outer coat 403, but also the absolute value of the amount of thermal shrinkage, the compact 410 is preferably heated to the lowest possible temperature and, in the embodiment shown above, a temperature of 750° C. is used.

In the embodiment shown, two communication holes 414 are provided in the joint 413 between two metal pipes 401 forming the base for the pipe element G. One communication hole provides a passage for the compact 410 that flows into the second space 434, and the other communication hole provides a passage for the compact 410 to be discharged into the receptacle 428 through the first gap 433 and passage hole 429 after the compact has been divided into two streams and are combined beneath the space 426 or second gap 434, accompanied by a temperature drop. It is essential for the purposes of the present invention that two communication holes 414 be provided on opposite sides of the joint 413. The cross section of each communication hole 414 may be circular or elliptical. The two communication holes may have different sizes depending upon the specific molding conditions.

The inner ring 415 may be composed of a thin wall since the reinforcing jig H is inserted into the through-hole 418; the ring itself need not have great mechanical strength. Because of this small wall thickness, the inner ring 415 will cause very small effects on the inside diameter of the joined corrosion-resistant pipes. The reinforcing jig H may be readily fixed in a predetermined position with the aid of a separate fixing jig.

A characteristic feature of the construction of the molding unit is the receptacle 428 with the passage hole 429 on the bottom of the lower mold 424. During the molding process, the compact 410, as pressurized by the plunger 408, passes through the holes 431 and 427 to reach a point above the space 426. At this point, part of the flowing compact is divided into two streams, one part of which flows on both sides of the first gap 433 and the other part passes through the upper communication hole 414. The two parts are combined at the lower part thereof, then divided again into two streams that flow on both sides of the second gap 434. The latter are combined below. In either case, the combined stream has its temperature decreased since it is flowing in contact with the walls of the molding unit and the surface of the base pipe element G. For this reason, the corrosion-resistant portion that has been formed by the two impinging streams is unable to retain a completely fused state. In the absence of the receptacle 428 in the molding unit, such a defective part would form at the bottom of the base pipe element G and cause subsequent cracking, which would eventually lead to deterioration of various characteristics. However, since the molding unit used in the present invention has the receptacle 428, defective parts will be pushed into the receptacle 428 through the passage hole 429, and the portion forming at the lower part of the linking coat 417 as a result of the joining of two streams retains a completely fused state.

As will be understood from the foregoing description, the linking coat 417 formed by a method of the present invention has a uniform density distribution and is entirely free from the possibility of cracking. This linking coat 417 is completely fused with the inner coat 402 and outer coat 403 so as to form an integral coating layer. Additionally, a desired number of short corrosion-resistant pipes can be connected to provide a long unit that meets the user's requirements.

The process of this embodiment of the present invention can be summarized as follows: a plurality of short corrosion-resistant pipes having a high mechanical strength are provided by forming a coat of a glass-mica molded body on both inner and outer surfaces of a metal pipe, the glass-mica molded body having a good thermal expansion coefficient matching with that of the metal, having no possibility of spalling or breaking upon repeated exposure to 300° to 320° C., and having a very strong resistance to the corrosive action of hot water, salt water or $H_2S$-containing water held at about 300° C.; part of the inner and outer coats are removed from each of the metal pipes; the exposed metal pipes are welded together to form a unit of the necessary length; and a glass-mica molded body having the same characteristics shown above but which has a different composition than the glass-mica molded body used in the inner and outer coats is deposited on both the inner and outer surfaces of the weld between the metal pieces so as to form a new linking coat that is completely bonded to the inner and outer coats on the connected short corrosion-resistant pipes. The resulting long pipe has entirely the same characteristics as the individual short pipes. This long corrosion-resistant pipe exhibits all the characteristics that must be possessed by casings which are used to recover the oil from underground oil-sand deposits by the steam drive method. Because of its effectiveness, the long corrosion-resistant pipe in accordance with the present invention is expected to made a great contribution to the efforts in the exploitation of new resources.

The process of the present invention for fabricating such long corrosion-resistant pipe eliminates all the defects that are encountered in the conventional method and, hence, will offer great technical and practical advantages in the art.

The foregoing description concerns the corrosion-resistant pipe intended for use as a casing in the oil recovery by the steam injection method. However, it should be understood that the pipe may be extensively used with advantage in chemical plants not only as a corrosion-resistant pipe but also as an insulated pipe.

Figures 26A, 26B:
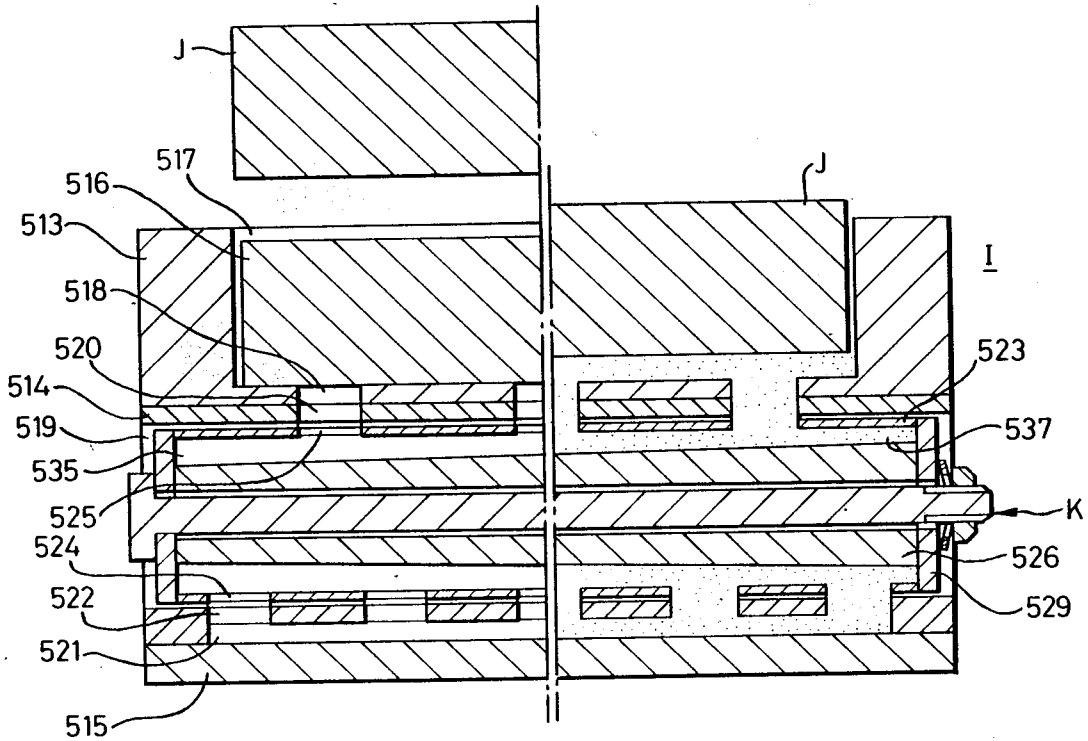
Figures 29A, 29B:
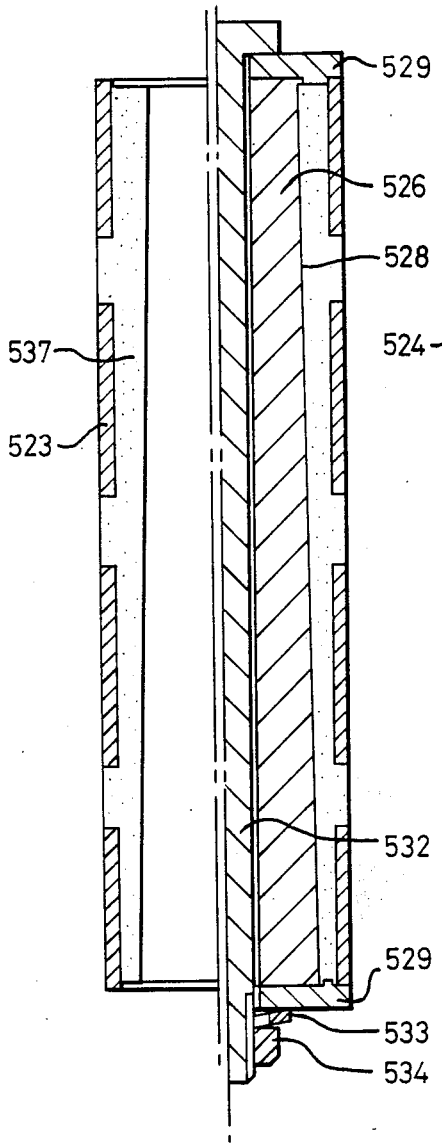
FIGS. 29A and 29B are, respectively, a longitudinal sectional view of a shaped article during processing and the completed product.
Figure 28:
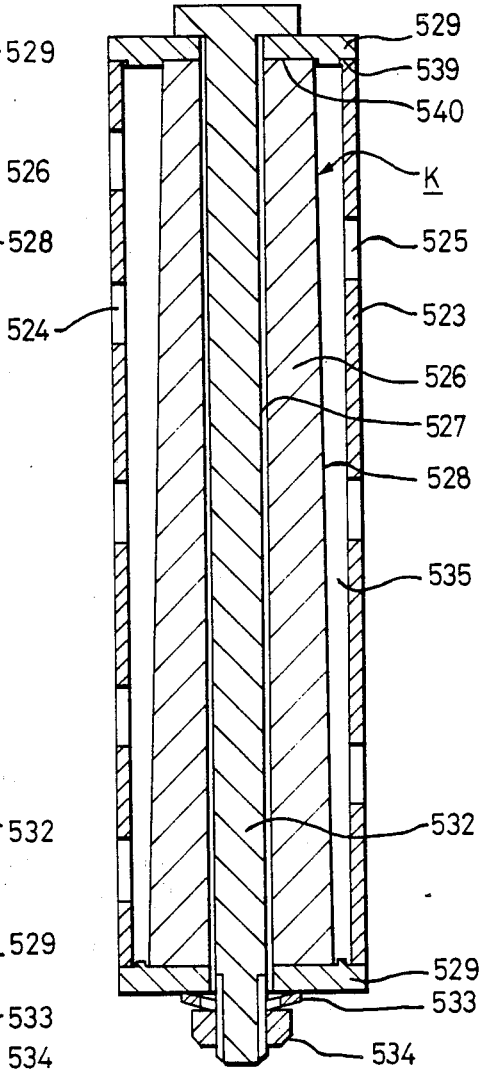
FIG. 28 shows a longitudinal sectional view of a shaping jig used in the embodiments of FIGS. 26A through 27B.

Another.embodiment of a shaping mold unit used in implementing the process of the present invention will hereunder be described with reference to FIGS. 26A and 26B. The mold unit is composed of a molding section I and a plunger J. The molding section I is an assembly of three components, an upper mold 513, a lower mold 514 divided into an upper part 514-1 and a lower part, and a support 515. The mating surfaces of each component are sealed against the outflow of a pressurized compact 516. The upper mold 513 is provided with a parallelpiped feed-filling cavity 517 at the top and a plurality of elongated drain channels 518 of a circular cross section at the bottom. The drain channels 518 extend from the bottom of the filling cavity 517 through the upper mold 513. In the embodiment shown in FIG. 26A, three rectangular drain channels 518 are provided. The upper part and lower part of the lower mold 514 are in contact with each other so that their mating surfaces define an imaginary plane that cuts through the center of a through-hole 519 extending in the transversal direction of the lower mold 514. The upper part is provided with a plurality of filling channels 520 that establish communication between the drain channels 518 in the upper mold 513 and the through-hole 519. The number and shape of the filling channels 520 are identical to those of the drain channels 518. The lower part of the lower mold 514 is provided with a rectangular receptacle 521, above which are provided a plurality of elliptical passage channels 522 extending to the through-hole 519. In the embodiment shown in FIGS. 26A and 26B, five passage channels 522 are provided.

The support 515 is placed under the lower mold 514 and provides a bottom surface for the receptacle 521 while holding the upper mold 513 and lower mold 514 in position. The plunger J has a shape that is fittable into the feed-filling cavity 517.

What is claimed is:

1. An electrode unit for electrically heating underground hydrocarbon resources, comprising:

an insulated pipe joint comprising an internal metal member made of a hollow cylinder with a ring surrounding an outer periphery of one end, an external metal member made of a hollow cylinder having at one end a ring formed on its inner periphery in a face-to-face relationship with said outer ring, and an insulator made of a glass-mica molded body that fills a gap between said external and internal members and which covers both an outer surface of said internal metal member and an inner surface of said external metal member;

an insulated pipe having an insulator coat of a glass-mica molded body and both ends butt welded to said insulated pipe joint;

a linking insulator made of a glass-mica molded body deposited on one end of each of said pipe joints from which part said insulator has been stripped and on the butt welded end of said insulated pipe from which part of said insulator coat has also been stripped; and an electrode connected to a lower end of said pipe joint positioned below said insulated pipe.

2. The electrode unit according to claim 1, wherein said insulator coat is formed on an outer surface of said pipe.

3. The electrode unit according to claim 1, wherein said insulator coat is formed on an inner surface of said pipe.

4. The electrode unit according to claim 1, wherein said insulator coat is formed on both inner and outer surfaces of said pipe.

* * * * *